US006779517B2

(12) United States Patent
Sakakura

(10) Patent No.: US 6,779,517 B2
(45) Date of Patent: Aug. 24, 2004

(54) IGNITION DEVICE FOR INTERNAL COMBUSTION ENGINE

(75) Inventor: Yasushi Sakakura, Komaki (JP)

(73) Assignee: NGK Spark Plug Co., Ltd., Aichi (JP)

( * ) Notice: Subject to any disclaimer, the term of this patent is extended or adjusted under 35 U.S.C. 154(b) by 41 days.

(21) Appl. No.: 10/305,351

(22) Filed: Nov. 27, 2002

(65) Prior Publication Data

US 2003/0116148 A1 Jun. 26, 2003

(30) Foreign Application Priority Data

Nov. 29, 2001 (JP) ..... P.2001-364732
Mar. 26, 2002 (JP) ..... P.2002-085756
Mar. 26, 2002 (JP) ..... P.2002-087062

(51) Int. Cl.[7] ..... F02P 11/00
(52) U.S. Cl. ..... 123/630; 123/655
(58) Field of Search ..... 123/630, 655, 123/618, 620; 73/35.08

(56) References Cited

U.S. PATENT DOCUMENTS 4,407,259 A * 10/1983 Abo ..... 123/620
5,561,239 A 10/1996 Yasuda
5,959,192 A * 9/1999 Mogi et al. ..... 73/35.08
6,116,226 A * 9/2000 Vogel ..... 123/609
6,118,276 A * 9/2000 Nakata et al. ..... 324/464
6,222,368 B1 * 4/2001 Inagaki et al. ..... 324/399
6,539,930 B2 * 4/2003 Inagaki ..... 123/655

FOREIGN PATENT DOCUMENTS

JP 7-217519 8/1995
JP 8-177703 7/1996
JP 9-137769 5/1997
JP 9-228941 9/1997
JP 10-18952 1/1998
JP 10-141197 5/1998
JP 3084673 B1 7/2000
JP 2001-82311 3/2001
JP 2001-173548 6/2001
JP 2001-193623 7/2001

* cited by examiner

*Primary Examiner*—Mahmoud Gimie
(74) *Attorney, Agent, or Firm*—Morgan, Lewis & Bockius LLP

(57) ABSTRACT

An ignition device for an internal combustion engine comprising: an ignition coil comprising a primary winding and a secondary winding, the ignition coil generating an igniting high voltage in the secondary winding by turning off a primary current flowing in the primary winding; an ignition switching unit; a spark plug connected to an igniting high voltage generation end of the secondary winding; a reverse current prevention unit series-connected on a current-conduction path of the discharge current connecting the secondary winding to the spark plug; a voltage application unit connected to an other end of the secondary winding opposite to the igniting high voltage generation end; an ionic current detection unit; and an ionic current detection switching unit series-connected on a current-conduction path of the ionic current-detecting voltage connecting the voltage application unit to the other end.

15 Claims, 10 Drawing Sheets

IGNITION DEVICE FOR INTERNAL COMBUSTION ENGINE

FIELD OF THE INVENTION

The present invention relates to an ignition device for internal combustion engine, having a function of generating a spark discharge between electrodes of a spark plug by applying an igniting high voltage generated in an ignition coil between the electrodes of the spark plug, and a function of generating an ionic current after completion of the spark discharge.

BACKGROUND OF THE INVENTION

In an internal combustion engine used as a car engine or the like, when an air-fuel mixture is burned by a spark discharge in a spark plug, ions are produced with the combustion of the air-fuel mixture. Therefore, if a voltage is applied between electrodes of the spark plug after the air-fuel mixture is burned by the spark discharge of the spark plug, an ionic current flows. Because the amount of produced ions varies in accordance with the state of combustion of the air-fuel mixture, ignition failure, knocking or the like can be detected if the ionic current is detected and analyzed.

As an example of a related-art ignition device for internal combustion engine having a function of generating such an ionic current, there is a device in which a center electrode 61 of a spark plug 13 is electrically connected to one end of a secondary winding 34 of an ignition coil 15 while a capacitor 45 is series-connected to the other end of the secondary winding 34 as shown in FIG. 4. The ignition device 101 for internal combustion engine is configured so that the capacitor 45 is charged by a discharge current 22 (secondary current 22) flowing in the secondary winding 34 of the ignition coil 15 and the spark plug 13 at the time of generation of a spark discharge in the spark plug 13, and so that the charged capacitor 45 is discharged after completion of the spark discharge to thereby apply a voltage between electrodes of the spark plug 13 through the secondary winding 34 to generate an ionic current 42. Further, a detection resistor 47 is provided at the other end of the capacitor 45 opposite to the secondary winding 34 so that the ionic current is detected on the basis of the voltage between opposite ends of the detection resistor 47.

Incidentally, in the ignition device 101 for internal combustion engine, a Zener diode 111 is provided in parallel to the capacitor 45 to prevent the capacitor 45 from being broken by overcharge and to limit the voltage between the opposite ends of the capacitor 45 to a constant value (100 to 300 V).

As described above, in the ignition device for internal combustion engine using the capacitor 45 as a power supply for detecting an ionic current, it is unnecessary to provide any special power supply unit (such as a battery) exclusively used for detecting an ionic current. Hence, there is an advantage that a relatively small number of parts can be used while the size of the ignition device can be reduced.

SUMMARY OF THE INVENTION

In the ignition device 101 for internal combustion engine, however, magnetic flux energy is stored in the ignition coil 15. For this reason, a voltage (several kV) reversed in polarity to an igniting high voltage is generated in the secondary winding 34 when current conduction to a primary winding 33 is started. Hence, there is fear that the spark plug

13 may generate a spark discharge before normal ignition timing to thereby cause wrong ignition of an air-fuel mixture.

FIG. 6 is a time chart showing states of a first command signal and the voltage between the opposite ends of the secondary winding in the ignition device 101 for internal combustion engine shown in FIG. 4. Incidentally, when the level of the first command signal is low, an igniter 17 is open-circuited so that there is no current flowing in the primary winding 33. On the other hand, when the level of the first command signal is high, the igniter 17 is short-circuited so that a current flows in the primary winding 33. In FIG. 6, the waveform of the voltage between the opposite ends of the secondary winding 34 is shown with the igniting high voltage as a negative-polarity voltage. Hence, points of time t12 and t15 show igniting high voltage generation timing (ignition timing).

In FIG. 6, points of time t11 and t14 show start timing for conduction of the primary current. It is found that a voltage (several kV) reversed in polarity to the igniting high voltage is generated between the opposite ends of the secondary winding 34 in this timing. There is fear that wrong ignition may be caused by this voltage.

To prevent the generation of such wrong ignition, in the ignition device 101 for internal combustion engine shown in FIG. 4, for example, a so-called reverse current prevention diode may be provided in a current-conduction path formed between one end of the secondary winding 34 and the spark plug 13 so that a current is allowed to flow in the current-conduction path of the secondary current 22 only at the time of conduction of the primary current 21.

If the reverse current prevention diode is provided in the ignition device 101 for internal combustion engine shown in FIG. 4, it is however impossible to detect an ionic current flowing in between the electrodes of the spark plug 13 because the capacitor 45 can be charged by the secondary current 22 but cannot be discharged due to the reverse current prevention diode.

An ignition device 103 for internal combustion engine shown in FIG. 5 is configured in consideration of this problem. In the ignition device 103, a reverse current prevention diode 31 is provided and an ionic current detection circuit 113 for applying an ionic current-detecting voltage to the spark plug 13 through a current-conduction path different from the secondary winding 34 is provided so that an ionic current can be detected. The ionic current detection circuit 113 is configured as follows. An ionic current-detecting voltage is applied to the spark plug 13 by an internal power supply 115. An ionic current is detected on the basis of the voltage between the opposite ends of the detection resistor 47. A discrimination circuit 55 outputs an ionic current detection result signal 24 to an electronic control unit. Incidentally, an applied voltage-limiting Zener diode 53 prevents a signal of an excessive voltage higher than the allowable maximum input voltage value from being input to the discrimination circuit 55. Hence, the discrimination circuit 55 is prevented from being broken.

In the ignition device 103 for internal combustion engine configured as described above, an inflow prevention diode 117 for preventing the secondary current 22 from flowing into the ionic current detection circuit 113 at the time of generation of the igniting high voltage is provided in order to prevent the ionic current detection circuit 113 from being broken by application of the igniting high voltage. In addition, the inflow prevention diode 117 prevents the secondary current 22 from leaking to the ionic current detection circuit 113. Hence, the inflow prevention diode 117 is also effective in preventing energy supplied to the spark plug 13 from being reduced at the time of generation of the igniting high voltage.

In the ignition device 103 for internal combustion engine shown in FIG. 5, it is however necessary to make the inflow prevention diode 117 from a high-voltage-proof diode of an allowable withstand voltage not lower than the igniting high voltage (about 40 kV) because the inflow prevention diode 117 is connected on the secondary high potential side. At the existing time, it is impossible to obtain such a diode constituted by one high-voltage-proof element.

Therefore, when a plurality of diodes series-connected in order to obtain an allowable withstand voltage not lower than the igniting high voltage as a whole are provided as the inflow prevention diode 117, the ignition device 103 for internal combustion engine shown in FIG. 5 can be achieved.

When such a plurality of diodes series-connected are used, however, the probability that a failure will be included in any one of the diodes becomes high. Hence, there is a problem that reliability is lowered compared with the case where the inflow prevention diode 117 is constituted by one diode. In addition, because the plurality of diodes are used under a particularly severe environment in which a high voltage is applied, there is also a problem that the probability that any one of the diodes will be broken is high.

For this reason, in the ignition device 103 for internal combustion engine shown in FIG. 5, there is fear that the ionic current 42 cannot be detected appropriately because the inflow prevention diode 117 is broken and cannot work normally.

If the ionic current detection circuit is connected to the other end of the secondary winding opposite to the igniting high voltage generation end in order to solve this problem, it is unnecessary to provide any high-voltage-proof diode.

When the ionic current detection circuit is simply connected to the other end of the secondary winding opposite to the igniting high voltage generation end, however, the ionic current-detecting voltage held in the ionic current detection circuit is absorbed to the other end of the secondary winding opposite to the igniting high voltage generation end at the time of generation of the discharge current. As a result, the ionic current-detecting voltage is lowered at the time of detection of the ionic current, so that there is fear that the ionic current cannot be detected appropriately.

Therefore, the invention aims at solving the problems and an object of the invention is to provide an ignition device for internal combustion engine in which wrong ignition of an air-fuel mixture can be restrained from being caused by a spark discharge generated in a spark plug at the time of carrying a current to a primary winding and in which an ionic current between electrodes of the spark plug can be generated and detected.

To achieve the foregoing object, in accordance with the invention, there is provided an ignition device for internal combustion engine having: an ignition coil including a primary winding, and a secondary winding, the ignition coil generating an igniting high voltage in the secondary winding by turning off a primary current flowing in the primary winding; an ignition switching unit for turning on/off the primary current flowing in the primary winding of the ignition coil; and a spark plug connected to an igniting high voltage generation end of the secondary winding for generating a spark discharge between electrodes of the spark plug in the condition that a discharge current generated on the basis of the igniting high voltage flows in the spark plug; the ignition device further having: a reverse current prevention unit series-connected on a current-conduction path of the discharge current connecting the secondary winding to the spark plug, the reverse current prevention unit permitting conduction of the discharge current in the spark plug but preventing conduction of a current generated in the secondary winding at the time of carrying a current to the primary winding; a voltage application unit connected to the other end of the secondary winding opposite to the igniting high voltage generation end for applying an ionic current-detecting voltage to the spark plug, the ionic current-detecting voltage being identical in polarity to the igniting high voltage applied to the spark plug; an ionic current detection unit for detecting an ionic current flowing in between the electrodes of the spark plug on the basis of application of the ionic current-detecting voltage; and an ionic current detection switching unit series-connected on a current-conduction path of the ionic current-detecting voltage connecting the voltage application unit to the other end of the secondary winding for making the current-conduction path non-conductive to apply the ionic current-detecting voltage at the time of generation of the igniting high voltage but making the current-conduction path conductive to apply the ionic current-detecting voltage at the time of detection of the ionic current on the basis of external commands.

That is, in the ignition device for internal combustion engine according to the invention, the reverse current prevention unit is provided on the current-conduction path of the discharge current connecting the secondary winding of the ignition coil to the spark plug so that the direction of the current allowed to be carried by the current-conduction path of the discharge current (secondary current) is limited to one direction. That is, the reverse current prevention unit prevents current conduction from being caused by the voltage (several kV) generated between the opposite ends of the secondary winding at the time of carrying a current to the primary winding, so that a spark discharge is prevented from being generated between the electrodes (center electrode and ground electrode) of the spark plug at the time of carrying a current to the primary winding.

Moreover, in the ignition device for internal combustion engine, the ionic current detection circuit is connected to the other end of the secondary winding opposite to the igniting high voltage generation end. Hence, because the ionic current detection circuit is not influenced by the igniting high voltage, it is unnecessary to provide any high-voltage-proof inflow prevention diode for protecting the ionic current detection circuit.

Moreover, in the ignition device for internal combustion engine, the ionic current detection switching unit is provided as well as the ionic current detection circuit is connected to the other end of the secondary winding opposite to the igniting high voltage generation end. Hence, the ionic current-detecting voltage stored in the voltage application unit can be prevented from being absorbed to the other end of the secondary winding opposite to the igniting high voltage generation end at the time of generation of the igniting high voltage. As a result, the ionic current-detecting voltage required at the time of detection of the ionic current can be applied to the spark plug so that the ionic current can be detected.

Incidentally, for example, the ionic current detection switching unit may be constituted by a switch which is formed so that an internal path of the switch is short-circuited or open-circuited on the basis of commands given from a control unit for controlling the operations of respective parts in the internal combustion engine. That is, the ionic current detection switching unit is formed so that the current-conduction path is made conductive when the ionic current detection switching unit is short-circuited, and that the current-conduction path is made non-conductive when the ionic current detection switching unit is open-circuited.

Moreover, the control unit for drive-controlling the ionic current detection switching unit is provided so that the time zone of making the current-conduction path conductive (i.e., ionic current detection window) can be changed on the basis of the operating state of the internal combustion engine. Hence, the ionic current detection window can be set to be adapted to the operating state of the internal combustion engine. Further, just after completion of the spark discharge, a large amount of noise component is superposed on the ionic current. Therefore, when the ionic current detection window is set so that the noise component can be avoided, the influence of noise is suppressed so that the ionic current can be detected accurately.

Preferably, in the ignition device for internal combustion engine, an auxiliary discharge path-forming unit provided in a position different from a path constituted by the voltage application unit, the ionic current detection unit and the ionic current detection switching unit may be provided as a current-conduction path for a current flowing in the secondary winding at the time of generation of an igniting high voltage. Hence, even in the case where the path constituted by the voltage application unit, the ionic current detection unit and the ionic current detection switching unit is electrically disconnected from the secondary winding by a certain cause, a current-conduction path can be constituted by the auxiliary discharge path-forming unit. Hence, the current-conduction path for the discharge current can be secured.

Incidentally, it is known that when a voltage is applied between electrodes of the spark plug to generate an ionic current, the ionic current which can be generated in the case where the voltage is applied so that the center electrode and the ground electrode are positive and negative respectively in terms of polarity is larger in quantity than the ionic current which can be generated in the case where the voltage is applied so that the center electrode and the ground electrode are negative and positive respectively in terms of polarity. This is because when positive ions large in volume are supplied with electrons from the ground electrode having a surface area larger than that of the center electrode, a larger amount of electrons can be exchanged and transferred.

That is, in the ignition device for internal combustion engine configured as described above, the polarity of the voltage applied to the center electrode of the spark plug by the igniting high voltage is preferably positive. Incidentally, the positive or negative polarity of each end portion of the secondary winding at the time of generation of the igniting high voltage can be set by adjustment of the respective winding directions of the primary and secondary windings in the ignition coil.

Incidentally, the voltage application unit provided in the ignition device for internal combustion engine may have a boosting unit by which a voltage given from an external power supply such as an on-vehicle battery is boosted to a predetermined voltage value required as the ionic current-detecting voltage so that the ionic current-detecting voltage can be output. Or the voltage application unit may be configured so that the ionic current-detecting voltage can be output on the basis of electric energy stored in the inside of the voltage application unit.

Therefore, in the ignition device for internal combustion engine, for example, the voltage application unit may be preferably formed electrically chargeably and dischargeably so that the voltage application unit is electrically charged by an interrupting-time primary induced voltage generated between opposite ends of the primary winding at the time of conduction of the discharge current in the spark plug to thereby apply the ionic current-detecting voltage to the spark plug.

At the time of conduction of the discharge current into the spark plug, an igniting high voltage is induced in the secondary winding and an induced voltage (interruption-time primary induced voltage) is generated in the primary winding by mutual induction. The interruption-time primary induced voltage is not lower than a voltage value (about 100 V to about 300 V) required for generating an ionic current. For this reason, the voltage application unit charged by the interruption-time primary induced voltage can store energy required for generating the ionic current and can output an ionic current-detecting voltage of not lower than the voltage value required for generating the ionic current.

The interruption-time primary induced voltage is also generated as the igniting high voltage to be applied to the spark plug is generated. Hence, because the voltage application unit can be charged by the interruption-time primary induced voltage, it is unnecessary to provide newly any charge voltage supply unit for supplying electric energy to charge the voltage application unit.

In the ignition device for internal combustion engine, for example, the voltage application unit may be preferably formed electrically chargeably and dischargeably so that the voltage application unit is electrically charged by a current-conduction-time secondary induced voltage generated between opposite ends of the secondary winding at the time of current-conduction of the primary winding to thereby apply the ionic current-detecting voltage to the spark plug.

At the time of conduction of the primary current, an induced voltage (current-conduction-time secondary induced voltage) is generated in the secondary winding. The current-conduction-time secondary induced voltage is lower in voltage value than the igniting high voltage but reaches about 2 kV or higher. That is, the current-conduction-time secondary induced voltage is not lower than the voltage value (about 100 V to about 300 V) required for generating the ionic current. Hence, the voltage application unit charged by the current-conduction-time secondary induced voltage can store energy required for generating the ionic current.

The current-conduction-time secondary induced voltage is also generated as conduction of the primary current starts for storing energy required for generating the igniting high voltage in the ignition coil. Hence, because the voltage application unit is charged by the current-conduction-time secondary induced voltage, it is necessary to provide newly any charge voltage supply unit for supplying electric energy to charge the voltage application unit.

In the ignition device for internal combustion engine, for example, the voltage application unit may be preferably formed electrically chargeably and dischargeably so that the voltage application unit is electrically charged by both a current-conduction-time secondary induced voltage generated between opposite ends of the secondary winding at the time of current-conduction of the primary winding and an interrupting-time primary induced voltage generated between opposite ends of the primary winding at the time of conduction of the discharge current in the spark plug to thereby apply the ionic current-detecting voltage to the spark plug.

That is, both current-conduction-time secondary induced voltage and the interruption-time primary induced voltage are used for charging the voltage application unit. Hence, when the voltage application unit is to be charged, energy required for generating the ionic current can be surely stored in the voltage application unit. In addition, it is unnecessary to provide newly any charge voltage supply unit for supplying electric energy to charge the voltage application unit.

Incidentally, as the method for charging the voltage application unit by the current-conduction-time secondary induced voltage, there is, for example, a method in which a current generated on the basis of the current-conduction-time secondary induced voltage is supplied to the voltage application unit through the ionic current detection switching unit. In this method, it is however necessary to execute a drive control process for making the ionic current detection switching unit conductive (short-circuited) in accordance with the charge timing. Hence, there is a problem that the process of controlling the ignition device for internal combustion engine is complicated.

Therefore, preferably, the ignition device for internal combustion engine may further have a charge path-forming unit connected in parallel to the ionic current detection switching unit for preventing conduction of the discharge current but permitting conduction of a current generated on the basis of the current-conduction-time secondary induced voltage, wherein the current generated on the basis of the current-conduction-time secondary induced voltage is supplied to the voltage application unit through the charge path-forming unit to thereby electrically charge the voltage application unit.

The charge path-forming unit can carry a current generated on the basis of the current-conduction-time secondary induced voltage to thereby supply the current to the voltage application unit. That is, because the charge path-forming unit is provided, the voltage application unit can be electrically charged by the current-conduction-time secondary induced voltage without execution of any complex control process for drive-controlling the ionic current detection switching unit in accordance with the charge timing. In addition, because the charge path-forming unit prevents conduction of a current generated in the secondary winding on the basis of the igniting high voltage, the voltage application unit is not influenced by the igniting high voltage.

Incidentally, when the charge path-forming unit is provided, it is preferable to suppress the influence of the igniting high voltage on the charge path-forming unit. Therefore, the charge path-forming unit may be preferably provided in the ignition device for internal combustion engine configured so that the high potential side end portion of the secondary winding at the time of generation of the igniting high voltage is connected to the center electrode of the spark plug through the reverse current prevention unit whereas the low potential side end portion of the secondary winding at the time of generation of the igniting high voltage is connected to the voltage application unit through the ionic current detection switching unit. Hence, the influence of the igniting high voltage on the charge path-forming unit can be suppressed to be small.

In the ignition device for internal combustion engine, for example, the charge path-forming unit may be preferably constituted by a diode.

The charge path-forming unit constituted by a diode is connected in parallel to the ionic current detection switching unit. The charge path-forming unit can prevent conduction of a current generated in the secondary winding on the basis of the igniting high voltage but can permit conduction of a current generated on the basis of the current-conduction-time secondary induced voltage. Hence, a charge path for charging the voltage application unit can be formed.

Incidentally, when a diode is used for permitting a current flowing from the secondary winding into the voltage application unit but preventing a current flowing from the voltage application unit into the secondary winding, the diode may be preferably provided so that an anode of the diode is connected to a junction point between the ionic current detection switching unit and the secondary wiring whereas a cathode of the diode is connected to a junction point between the ionic current detection switching unit and the voltage application unit.

In the ignition device for internal combustion engine, for example, the voltage application unit may be preferably constituted by a capacitor.

That is, because the capacitor is a chargeable and dischargeable capacitance element, the capacitor can be charged by the interruption-time primary induced voltage or the current-conduction-time secondary induced voltage and can output the ionic current-detecting voltage. Hence, when the voltage application unit is constituted by a capacitor, the ionic current-detecting voltage can be applied to the spark plug.

Preferably, the ignition device for internal combustion engine may further have a protection unit for protecting the voltage application unit by limiting the charge voltage of the voltage application unit to be not higher than an allowable maximum charge voltage value.

The provision of the protection unit can prevent the voltage application unit from being overcharged at the time of charging the voltage application unit and can prevent the voltage application unit from being broken due to the overcharging.

Moreover, because the protection unit limits the charge voltage of the voltage application unit to be not higher than the allowable maximum charge voltage value, the charge voltage of the voltage application unit can be kept substantially constant at the allowable maximum charge voltage value. Hence, the ionic current-detecting voltage output from the voltage application unit can be kept substantially constant. In addition, because the ionic current-detecting voltage can be kept substantially constant, the detection value of the ionic current can be prevented from varying in accordance with the change of the voltage value of the ionic current-detecting voltage.

In the ignition device for internal combustion engine, for example, the protection unit may be preferably constituted by a Zener diode.

That is, when the voltage (charge voltage) between the opposite ends of the voltage application unit is not lower than the Zener voltage (break-down voltage) of the Zener diode, a current is carried by the Zener breakdown of the Zener diode. Hence, the charge voltage of the voltage application unit can be limited to be not higher than the allowable maximum charge voltage value, so that the voltage application unit can be protected.

Incidentally, in this case, as the Zener diode, there may be preferably used a Zener diode exhibiting a Zener voltage not higher than the allowable maximum charge voltage value of the voltage application unit.

For example, in order to prevent overcharge to protect the voltage application unit when a current flows from the ionic current detection switching unit into the voltage application unit, the Zener diode may be preferably provided so that a cathode of the Zener diode is connected to an end of the voltage application unit connected to the ionic current detection switching unit whereas an anode of the Zener diode is connected to the other end of the voltage application unit.

Incidentally, when conduction of the discharge current is interrupted with the completion of the spark discharge, magnetic flux density in the ignition coil changes. With the change of magnetic flux density, an induced voltage is generated in the secondary winding. Hence, the secondary winding in which the induced voltage is generated and the stray capacitance of the ionic current-conduction path constitute a resonant circuit, so that voltage-damping oscillation is generated. Hence, when the voltage application unit and the secondary winding are connected to each other in the condition that the resonant circuit is formed, charge stored in the voltage application unit is absorbed to the secondary winding by the influence of the voltage-damping oscillation. As a result, the output voltage of the voltage application unit is reduced. Hence, there is fear that the ionic current-detecting voltage cannot be applied.

Incidentally, such voltage-damping oscillation is not continued for a long time up to the start timing of current conduction into the primary winding in the next combustion cycle after interruption of conduction of the discharge current due to the completion of the spark discharge but is extinguished (converged) after the passage of a predetermined time.

Therefore, preferably, the ignition device for internal combustion engine may further have a detection timing control unit for drive-controlling the ionic current detection switching unit to make the current-conduction path conductive to apply the ionic current-detecting voltage after the passage of a detection delay time required for convergence of voltage-damping oscillation generated on the secondary side of the ignition coil after completion of a spark discharge in the spark plug.

That is, configuration is made so that the ionic current-detecting voltage is applied to the spark plug by drive-controlling the ionic current detection switching unit not just after completion of the spark discharge but after the passage of a detection delay time after the completion of the spark discharge. Because the ionic current detection switching unit is drive-controlled after the passage of the detection delay time after the completion of the spark discharge in this manner, charge stored in the voltage application unit can be prevented from being absorbed to the secondary winding by the influence of the voltage-damping oscillation.

Incidentally, because the voltage-damping oscillation is converged after the passage of a predetermined time after the completion of the spark discharge as described above, the influence of the voltage-damping oscillation can be surely avoided at the time of detection of the ionic current if the detection delay time is set to be not shorter than the time required for convergence of the voltage-damping oscillation.

Moreover, because configuration is made so that the ionic current is detected by applying the ionic current-detecting voltage to the spark plug after the passage of the detection delay time after the completion of the spark discharge, the ionic current can be detected without influence of noise superposed on the ionic current on the basis of generation of the voltage-damping oscillation just after the completion of the spark discharge.

Next, there has been recently discussed a technique in which the ionic current flowing due to ions near to the electrodes of the spark plug just after the completion of the spark discharge generated between the electrodes of the spark plug is used for detecting knocking. If knocking occurs in the internal combustion engine, the air-fuel mixture is compressed by the shock wave of knocking so that the ionic current vibrates. When, for example, the vibration of the ionic current value is not smaller than a predetermined value, a decision can be made that knocking is present. On the other hand, when the vibration of the ionic current value is smaller than the predetermined value, a decision can be made that knocking is absent. Incidentally, there is a knocking generation timing difference between an operating state in which the combustion of the air-fuel mixture progresses slowly (low rotational speed and low load state) and an operating state in which the combustion of the air-fuel mixture progresses rapidly (high rotational speed and high load state). Specifically, the knocking generation timing in an operating state in which the combustion of the air-fuel mixture progresses rapidly is earlier than that in an operating state in which the combustion of the air-fuel mixture progresses slowly.

Therefore, if the spark discharge duration is set to be long under the operating condition that the combustion of the air-fuel mixture progresses rapidly, knocking may occur in the spark discharge duration. Hence, there is fear that the knocking cannot be detected on the basis of the ionic current at the time of completion of the spark discharge.

Therefore, preferably, the ignition device for internal combustion engine may further have: a spark discharge duration calculation unit for calculating a spark discharge duration required for combustion of an air-fuel mixture by the spark discharge of the spark plug, on the basis of an operating state of the internal combustion engine; and a spark discharge interruption unit for forcibly interrupting the spark discharge of the spark plug in accordance with the spark discharge duration calculated by the spark discharge duration calculation unit.

In this manner, in the ignition device for internal combustion engine having the spark discharge interruption unit, the spark discharge completion timing is not fixed as the completion timing based on natural extinction but can be set to any timing in accordance with the operating state of the internal combustion engine. In addition, because the spark discharge is forcibly interrupted in accordance with the spark discharge duration calculated on the basis of the operating state of the internal combustion engine, knocking can be detected before extinction of the generated knocking even in the operating state in which the combustion of the air-fuel mixture progresses rapidly.

Because generation of ions accompanies combustion of the air-fuel mixture (fuel), the ion generation timing in an operating state in which the combustion of the air-fuel mixture progresses rapidly is earlier than that in an operating state in which the combustion of the air-fuel mixture progresses slowly. Accordingly, when the spark discharge is forcibly interrupted in accordance with the spark discharge duration calculated on the basis of the operating state of the internal combustion engine as shown in the invention, the timing of generation of knocking overlaps the timing of production of a large number of ions so that accuracy in detection of knocking can be improved more greatly.

For example, the spark discharge interruption unit may be preferably formed so that the spark discharge interruption unit forcibly interrupts the spark discharge of the spark plug by re-starting current conduction to the primary winding in accordance with the timing that the spark discharge duration has passed after the ignition switching unit turns off the current flowing in the primary winding of the ignition coil.

That is, generation of the spark discharge is performed by use of the principle of carrying a current to the primary winding of the ignition coil to induce magnetic flux and then interrupting the conduction of the current to change magnetic flux rapidly to induce a high voltage in the secondary winding of the ignition coil. When a current is carried to the primary winding once again while the spark discharge is generated, the direction of the change of the primary current flowing in the primary winding is reversed from a decreasing direction to an increasing direction. As a result, the direction of the change of magnetic flux in the ignition coil is reversed, so that the induced voltage generated between the opposite ends of the secondary winding is reduced. Because the induced voltage generated in the secondary winding is reduced by re-starting the current conduction into the primary winding in this manner, the voltage applied to the spark plug can be reduced to a value lower than the required value necessary for generation of the spark discharge.

That is, if the spark discharge interruption unit is formed so that the current conduction to the primary winding of the ignition coil is re-started, the voltage applied to the spark plug can be reduced to a value lower than the required value. As a result, the spark discharge in the spark plug can be forcibly interrupted.

Incidentally, when the spark discharge is forcibly interrupted, the detection timing control unit may start application of the ionic current-detecting voltage at the point of time when the detection delay time has passed after the forcible interruption timing as the starting point. On the other hand, when the spark discharge is not forcibly interrupted, application of the ionic current-detecting voltage may be started at the point of time when the detection delay time has passed after the natural extinction timing of the spark discharge.

Incidentally, in a recent central electronic control unit (ECU) for internal combustion engine, there are executed many control processes not only for ignition control but also for air-fuel ratio control, fuel injection timing control, etc. on the basis of input signals given from sensors (such as a crank angle sensor, an exhaust gas detection sensor, etc.) provided in respective parts of the internal combustion engine. Hence, load on internal processing by the ECU becomes considerably large. Therefore, when a unit for generating and detecting the ionic current is provided, it is preferable to design the unit so that the load on processing by the ECU does not increase.

Therefore, preferably, in the ignition device for internal combustion engine, the external commands are controlled by a switching drive unit for switching-controlling the ionic current detection switching unit on the basis of at least one of a duration of conduction of the primary current and the spark discharge duration.

That is, the ionic current detection switching unit can be switching-controlled without a new signal set in the ECU. Hence, the ionic current can be generated and detected well without increase of load on the ECU.

BRIEF DESCRIPTION OF THE DRAWINGS

FIG. 1 is an electric circuit diagram showing the configuration of an ignition device for internal combustion engine, having an ionic current detecting function according to a first embodiment of the invention.

FIG. 2 is a time chart showing states of respective parts in the ignition device for internal combustion engine according to the first embodiment.

FIG. 3 is a flow chart showing the contents of an ionic current detecting process executed by an electronic control unit (ECU) in the ignition device for internal combustion engine according to the first embodiment.

FIG. 4 is an electric circuit diagram showing the configuration of a related-art ignition device for internal combustion engine, having an ionic current generating function.

FIG. 5 is an electric circuit diagram showing the configuration of a related-art ignition device for internal combustion engine, having a reverse current prevention diode and having an ionic current generating function.

FIG. 6 is a time chart showing states of a first command signal and a voltage between opposite ends of a secondary winding in the related-art ignition device for internal combustion engine depicted in FIG. 4.

FIG. 7 is an electric circuit diagram showing the configuration of a second ignition device for internal combustion engine according to a second embodiment of the invention, which device has an ionic current detecting function and is formed so that the spark discharge duration can be set.

FIG. 8 is a time chart showing states of respective parts in the second ignition device for internal combustion engine according to the second embodiment.

FIG. 9 is a flow chart showing the contents of a second ionic current detecting process executed by an electronic control unit (ECU) in the second ignition device for internal combustion engine according to the second embodiment.

FIG. 10 is an electric circuit diagram showing the configuration of a third ignition device for internal combustion engine according to a third embodiment of the invention, which device is formed to have a second auxiliary diode.

FIG. 11 is an electric circuit diagram showing the configuration of a fourth ignition device for internal combustion engine according to a fourth embodiment of the invention, which device is formed to have a switching drive unit.

FIG. 12 is a time chart showing states of respective parts in the fourth ignition device for internal combustion engine according to the fourth embodiment.

DESCRIPTION OF THE REFERENCE NUMERALS

1 . . . ignition device for internal combustion engine, 2 . . . second ignition device for internal combustion engine, 3 . . . third ignition device for internal combustion engine, 4 . . . fourth ignition device for internal combustion engine, 11 . . . power supply unit (battery), 13 . . . spark plug, 15 . . . ignition coil, 17 . . . igniter, 19 . . . electronic control unit (ECU), 31 . . . reverse current prevention diode, 32 . . . auxiliary diode, 33 . . . primary winding, 34 . . . secondary winding, 35 . . . low potential side end portion, 36 . . . high potential side end portion, 41 . . . ionic current detection circuit, 43 . . . ionic current detection switch, 45 . . . voltage application capacitor, 47 . . . detection resistor, 49 . . . first charge path-forming diode, 50 . . . second charge path-forming diode, 51 . . . protection Zener diode, 53 . . . applied voltage-limiting Zener diode, 55 . . . discrimination circuit, 61 . . . center electrode, 63 . . . outer electrode (ground electrode), 65 . . . primary winding short-circuiting switch, 68 . . . second auxiliary diode, 69 . . . waveform generation circuit, 201 . . . switching drive control circuit, 202 . . . current-conduction duration detection circuit, 203 . . . discharge duration detection circuit, 204 . . . switching drive circuit, 216 . . . current-conduction command signal, 226 . . . discharge command signal.

DETAILED DESCRIPTION OF THE INVENTION

Embodiments of the invention will be described below with reference to the drawings.

Figure 1:
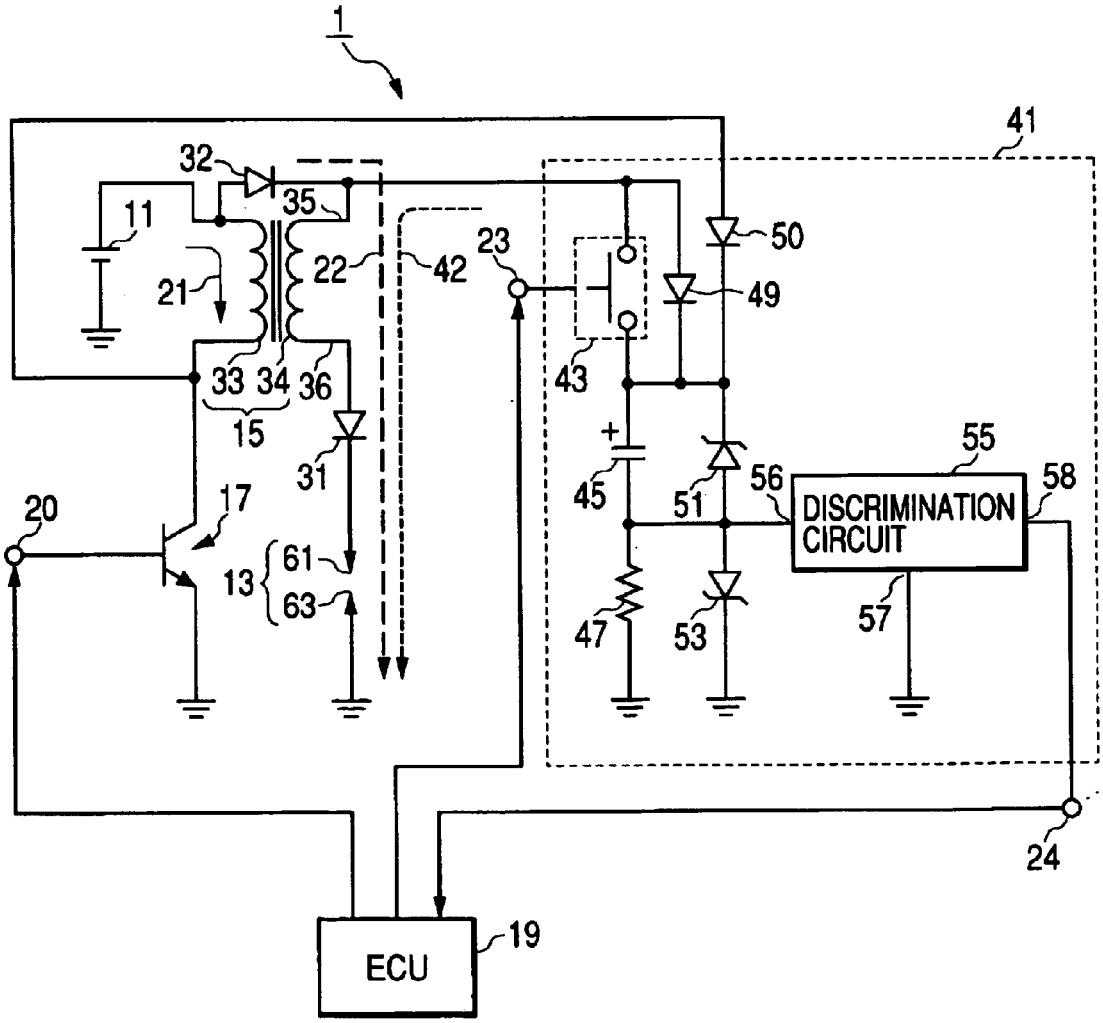
[FIG. 1]

First, FIG. 1 is an electric circuit diagram showing a configuration of an ignition device for internal combustion engine, having an ionic current detecting function according, to a first embodiment. Incidentally, although the first embodiment will be described on an internal combustion engine provided with one cylinder as an example, the invention is also applicable to an internal combustion engine provided with a plurality of cylinders. Ignition devices for the latter internal combustion engine, that is, ignition devices provided for the cylinders respectively are equivalent to one another in basic configuration.

As shown in FIG. 1, an ignition device 1 for internal combustion engine according the first embodiment has a power supply unit 11 (battery 11), a spark plug 13, an ignition coil 15, an igniter 17, and an electronic control unit 19 (hereinafter referred to as ECU 19). The power supply unit 11 outputs a constant voltage (e.g., of 12 V). The spark plug 13 has a center electrode 61, and a ground electrode 63 (also referred to as outer electrode 63). The spark plug 13 is mounted in each cylinder of an internal combustion engine. The ignition coil 15 has a primary winding 33, and a secondary winding 34. The ignition coil 15 generates an igniting high voltage. The igniter 17 has an IGBT (insulated gate bipolar transistor) series-connected to the primary winding 33. The ECU 19 outputs a first command signal 20 for drive-controlling the igniter 17.

The ignition device 1 for internal combustion engine further has an ionic current detection circuit 41 for detecting an ionic current 42 which is generated between electrodes of the spark plug 13 by application of an ionic current-detecting voltage to the spark plug 13 through the secondary winding 34 and a reverse current prevention diode 31.

Among these members, the igniter 17 is a switching element constituted by a semiconductor device which makes a switching operation in accordance with the first command signal 20 given from the ECU 19 in order to turn on/off current conduction to the primary winding 33 of the ignition coil 15. The ignition device provided in the internal combustion engine according to the first embodiment is a contactless transistor type ignition device. In addition, the igniter 17 has a gate connected to a first command signal 20 output terminal of the ECU 19, a collector connected to the primary winding 33, and an emitter connected to the ground having a potential equal to that of a negative electrode of the power supply unit 11.

The primary winding 33 of the ignition coil 15 has one end connected to a positive electrode of the power supply unit 11, and the other end connected to the collector of the igniter 17. The secondary winding 34 has a low potential side end portion 35 which is on the low potential side when the igniting high voltage is generated and which is connected, through an auxiliary diode 32, to an end portion of the primary winding 33 connected to the positive electrode of the power supply unit 11, and a high potential side end portion 36 (igniting high voltage generation end) which is on the high potential side when the igniting high voltage is generated and which is connected to an anode of the reverse current prevention diode 31. Incidentally, the auxiliary diode 32 has an anode connected to the primary winding 33, and a cathode connected to the secondary winding 34.

Further, the reverse current prevention diode 31 has an anode connected to the secondary winding 34, and a cathode connected a center electrode 61 of the spark plug 13. The reverse current prevention diode 31 permits a current flowing from the secondary winding 34 toward the center electrode 61 of the spark plug 13 but prevents a current from flowing from the center electrode 61 of the spark plug 13 toward the secondary winding 34.

Further, in the spark plug 13, the center electrode 61 and a ground electrode 63 are disposed opposite to each other so that a spark discharge gap for generating a spark discharge is formed between the center electrode 61 and the ground electrode 63. The ground electrode 63 is connected to the ground having a potential as high as the negative electrode of the power supply unit 11.

Further, a junction point between the low potential side end portion 35 of the secondary wiring 34 and the auxiliary diode 32 is connected to the ionic current detection circuit 41.

Next, the ionic current detection circuit 41 has an ionic current detection switch 43, a voltage application capacitor 45, a detection resistor 47, a first charge path-forming diode 49, a second charge path-forming diode 50, a protection Zener diode 51, an applied voltage-limiting Zener diode 53 and a discrimination circuit 55.

First, the ionic current detection switch 43 has one end connected to the low potential side end portion 35 of the secondary winding 34, and the other end connected to the voltage application capacitor 45. Further, the detection resistor 47 has one end connected to the ground having a potential as high as the negative electrode of the power supply unit 11, and the other end connected to the voltage application capacitor 45. That is, the ionic current detection switch 43, the voltage application capacitor 45 and the detection resistor 47 are series-connected in order so as to be disposed between the low potential side end portion 35 of the secondary winding 35 and the ground.

Further, the ionic current detection switch 43 is configured so that an internal path of the ionic current detection switch 43 is short-circuited or open-circuited in accordance with the detection command signal 23 given from the ECU 19. A current-conduction path connecting the secondary winding 34 to the voltage application capacitor 45 can be made conductive or non-conductive by the ionic current detection switch 43. Incidentally, the ionic current detection switch 43 is short-circuited when the level of the detection command signal 23 is high, but the ionic current detection switch 43 is open-circuited when the level of the detection command signal 23 is low.

Further, the first charge path-forming diode 49 has an anode connected to a junction point between the ionic current detection switch 43 and the low potential side end portion 35 of the secondary winding 34, and a cathode connected to a junction point between the ionic current detection switch 43 and the voltage application capacitor 45. The second charge path-forming diode 50 has an anode connected to a junction point between the collector of the igniter 17 and the primary winding 33, and a cathode connected to a junction point between the ionic current detection switch 43 and the voltage application capacitor 45.

Next, the protection Zener diode 51 has an anode connected to a junction point between the voltage application capacitor 45 and the detection resistor 47, and a cathode connected to a junction point between the voltage application capacitor 45 and the ionic current detection switch 43. The Zener voltage (break-down voltage) of the protection Zener diode 51 is selected to be not lower than the discharge voltage value (e.g., 300 V) of the voltage application capacitor 45 required for generating an ionic current 42 between the electrodes of the spark plug 13 and not higher than the allowable maximum charge voltage value of the charge voltage of the voltage application capacitor 45.

Further, the applied voltage-limiting Zener diode 53 has an anode connected to a junction point between the voltage application capacitor 45 and the detection resistor 47, and a cathode connected to the ground having a potential as high as the negative electrode of the power supply unit 11. The Zener voltage (break-down voltage) of the applied voltage-limiting Zener diode 53 is selected to be not higher than the allowable maximum value (e.g., 5 V) of the input voltage allowed to be input to a detection terminal 56 of the discrimination circuit 55.

Incidentally, the resistance value of the detection resistor 47 is selected to be in a voltage range suitable for an input signal given to the discrimination circuit 55 so that the voltage between opposite ends of the detection resistor 47 is prevented from becoming extremely low.

The discrimination circuit 55 has a detection terminal 56 connected to a junction point between the voltage application capacitor 45 and the detection resistor 47, a reference terminal 57 connected to the ground having a potential as high as the negative electrode of the power supply unit 11, and an output terminal 58 connected to an ionic current detection result signal 24 input terminal of the ECU 19. The discrimination circuit 55 is configured so that the ionic current 42 generated between the electrodes of the spark plug 13 (i.e., between the center electrode 61 and the ground electrode 63) is detected on the basis of the voltage between the opposite ends of the detection resistor 47 (i.e., in practice, the potential at the junction point between the detection resistor 47 and the voltage application capacitor 45), and so that anionic current detection result signal 24 varying in accordance with the detected ionic current 42 is output from the discrimination circuit 55.

Incidentally, at the time of generation of the ionic current, the voltage between the opposite ends of the detection resistor 47 exhibits a value proportional to the current value of the ionic current 42 because the detection resistor 47 and the spark plug 13 are series-connected in the current-conduction path of the ionic current 42. The discrimination circuit 55 is configured so that the range of change of the ionic current detection result signal 24 output from the discrimination circuit 55 does not depart from the range allowed to be input to the ECU 19.

Next, an operation of generating a spark discharge in the spark plug 13 in the internal combustion engine ignition device 1 configured as described above will be described.

First, when the level of the first command signal 20 output from the ECU 19 is low (generally, ground potential), the igniter 17 is off (interruption state) because there is no voltage applied between the gate and the emitter of the igniter 17. In this case, there is no current (primary current 21) flowing in the primary winding 33. On the other hand, when the level of the first command signal 20 output from the ECU 19 is high (generally, a supply voltage of 5 V is given from a constant-voltage power supply), the igniter 17 is on (current-conduction state) because a voltage is applied between the gate and the emitter of the igniter 17. In this case, a current (primary current 21) flows in the primary winding 33. As conduction of the primary current 21 is continued, magnetic flux energy is stored in the ignition coil 15.

When the high level of the first command signal 20 is changed to a low level in the condition that the primary current 21 flows in the primary winding 33, the igniter 17 is turned off so that conduction of the primary current 21 to the primary winding 33 is interrupted (stopped) precipitously. As a result, magnetic flux density in the ignition coil 15 changes rapidly.

Hence, an igniting high voltage (about 40 kV) is electromagnetically induced in the secondary winding 34, so that a spark discharge is generated between the electrodes 61 and 63 of the spark plug 13.

Incidentally, the ignition coil 15 is configured to generate an igniting high voltage so that the potential at the high potential side end portion 36 of the secondary winding 34 and the potential at the low potential side end portion 35 of the secondary winding 34 are made high and low respectively when current conduction to the primary winding 33 is interrupted (stopped). Accordingly, an igniting high voltage is applied to the spark plug 13 so that the center electrode 61 and the ground electrode 63 in the spark plug 13 have high potential (positive electrode potential) and low potential (negative electrode potential) respectively. As a result, a spark discharge is generated between the electrodes of the spark plug 13.

On this occasion, the secondary current 22 (discharge current 22) flowing in the secondary winding 34 while accompanying the spark discharge passes, from the secondary winding 34, through the reverse current prevention diode 31, the center electrode 61 of the spark plug 13 and the ground electrode 63 of the spark plug 13 in order and further flows back to the secondary winding 34 through the ground, the power supply unit 11 and the auxiliary diode 32. Energy stored in the ignition coil 15 is consumed as the spark discharge in the spark plug 13 is continued. When the energy becomes lower than an amount required for the continuation of the spark discharge, the spark discharge in the spark plug 13 is extinguished naturally.

Next, in the ignition device 1 for internal combustion engine, an operation for applying an ionic current-detecting voltage between the electrodes of the spark plug 13 and an operation for detecting an ionic current 42 generated by application of the ionic current-detecting voltage will be described.

First, when a primary current 21 is carried to the primary winding 33 to store magnetic flux energy in the ignition coil 15, magnetic flux density in the ignition coil 15 is changed by conduction of the primary current 21. As a result, an induced voltage (current-conduction-time secondary induced voltage) is generated in the secondary winding 34. Incidentally, the current-conduction-time secondary induced voltage reaches about 2 kV. The voltage is not lower than the voltage value (about 100 V to about 300 V) required for generating an ionic current and has polarity reversed to the igniting high voltage.

When the current-conduction-time secondary induced voltage is generated in this manner so that the low potential end portion 35 and the high potential end portion 36 of the secondary winding 34 become high and low respectively in terms of potential, charge transfer occurs among the secondary winding 34, the first charge path-forming diode 49 and the voltage application capacitor 45 with the potential change. As a result, the voltage application capacitor 45 is charged by the charge transfer. Incidentally, the charge transfer occurs in accordance with the flowing direction of a current on the assumption that the nearly central position of the secondary winding 34 is connected to the ground.

Further, when current conduction to the primary winding 33 is interrupted to generate an igniting high voltage in the secondary winding 34, an induced voltage (interruption-time primary induced voltage) is generated in the primary winding 33 by mutual induction as well as the igniting high voltage is induced in the secondary winding 34. When the interruption-time primary induced voltage is generated, a current flows from the primary winding 33 to the voltage application capacitor 45 through the second charge path-forming diode 50 so that the voltage application capacitor 45 is charged. Incidentally, the interruption-time primary induced voltage reaches about 400 V and is not lower than the voltage value (about 100 V to about 300 V) required for generating an ionic current.

The voltage application capacitor 45 charged by the current-conduction-time secondary induced voltage or the interruption-time primary induced voltage in this manner begins to be discharged when the ionic current detection switch 43 is short-circuited after the spark discharge in the spark plug 13 is extinguished naturally.

When there are ions in a combustion chamber at the time of discharging the voltage application capacitor 45, an ionic current corresponding to the amount of produced ions flows in between the electrodes of the spark plug 13. Hence, a current having a current value corresponding to the amount of produced ions flows in the voltage application capacitor 45, the ionic current detection switch 43, the secondary winding 34, the reverse current prevention diode 31, the spark plug 13, the ground and the detection resistor 47 in order, so that the voltage between the opposite ends of the detection resistor 47 exhibits a voltage value corresponding to the ionic current.

On the other hand, when there is no ion in the combustion chamber at the time of discharging the voltage application capacitor 45, there is no ionic current flowing in between the electrodes of the spark plug 13 even in the case where the ionic current detection switch 43 is short-circuited. As a result, there is no voltage generated between the opposite ends of the detection resistor 47.

When an ionic current is generated between the electrodes of the spark plug 13, a voltage proportional to the magnitude of the detection current is generated between the opposite ends of the detection resistor 47 so that the voltage between the opposite ends of the detection resistor 47 changes in proportion to the magnitude of the detection current (ionic current). Incidentally, if the voltage between the opposite ends of the detection resistor 47, that is, the voltage applied to the applied voltage-limiting Zener diode 53 is lower than the break-down voltage (Zener voltage) of the applied voltage-limiting Zener diode 53 when an ionic current is generated between the electrodes of the spark plug 13, there is no current flowing in the applied voltage-limiting Zener diode 53. In this case, a detection current proportional to the ionic current flows in the voltage application capacitor 45, the ionic current detection switch 43, the secondary winding 34, the reverse current prevention diode 31, the spark plug 13, the ground and the detection resistor 47.

When the detection current flows in this manner so that the voltage between the opposite ends of the detection resistor 47 changes, the discrimination circuit 55 outputs an ionic current detection result signal 24 to the ECU 19 on the basis of the detected voltage between the opposite ends of the detection resistor 47. Incidentally, the discrimination circuit 55 is provided so that the ionic current detection result signal 24 exhibiting the same change as that of the voltage between the opposite ends of the detection resistor 47 within a range corresponding to the input range of the input terminal of the ECU 19 is output from the output terminal 58.

Figure 2:
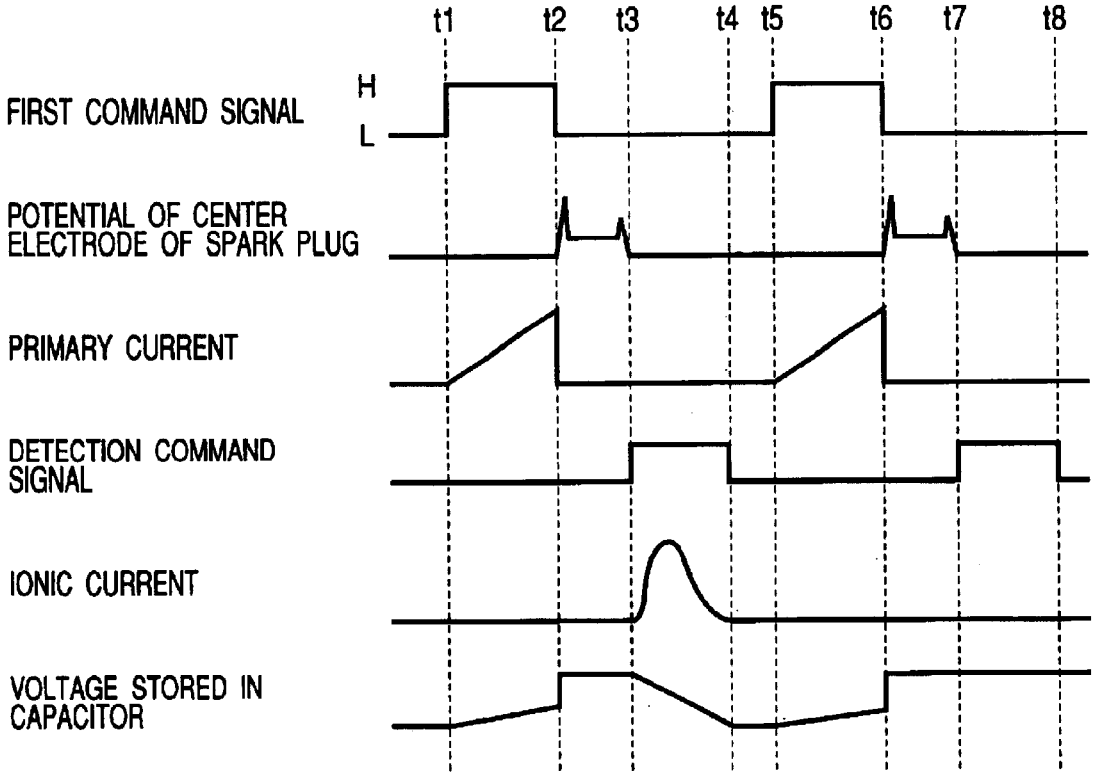
[FIG. 2]

FIG. 2 is a time chart showing states of the first command signal 20, the potential Vp of the center electrode 61 of the spark plug 13, the primary current 21 flowing in the primary winding 33, the detection command signal 23, the voltage between the opposite ends of the detection resistor 47 (in other words, ionic current) and the voltage (stored voltage) between the opposite ends of the voltage application capacitor 45 in the circuit diagram shown in FIG. 1.

As shown in FIG. 2, when the level of the first command signal 20 changes from low to high at a point of time t1, a current (primary current 21) begins to flow in the primary winding 33 of the ignition coil 15. On this occasion, a current-conduction-time secondary induced voltage is generated between the opposite ends of the secondary winding 34 on the basis of the change of magnetic flux density with the start of conduction of the primary current 21. On this occasion, this voltage is generated so that the low potential side end portion 35 and the high potential side end portion 36 of the secondary winding 34 have high potential and low potential respectively. For this reason, a current generated by the current-conduction-time secondary induced voltage generated between the opposite ends of the secondary winding 34 at the time of conduction of the primary current 21 is prevented by the reverse current prevention diode 31 from conducting. Hence, there is no potential change of the center electrode 61 of the spark plug 13, so that there is no spark discharge generated between the electrodes 61 and 63 of the spark plug 13. As described above, however, charge transfer occurs among the secondary winding 34, the first charge path-forming diode 49 and the voltage application capacitor 45 on the basis of generation of the current-conduction-time secondary induced voltage. Hence, the voltage application capacitor 45 is charged on the basis of the charge transfer so that the end of the capacitor 45 connected to the ionic current detection switch 43 forms a positive electrode (high potential).

When the level of the first command signal 20 changes from low to high at a point of time t2 after the passage of a predetermined current conduction time (primary current conduction time) from the point of time t1 as the starting point, conduction of the primary current 21 to the primary winding 33 of the ignition coil 15 is interrupted so that magnetic flux density changes rapidly. Hence, an igniting high voltage (about 40 kV) is generated in the secondary winding 34 of the ignition coil 15. The igniting high voltage of positive polarity is applied to the center electrode 61 of the spark plug 13 through the high potential side end portion 36 of the secondary winding 34, so that the potential of the center electrode 61 increases rapidly. As a result, a spark discharge is generated between the electrodes 61 and 63 of the spark plug 13, so that a secondary current 22 flows in the secondary winding 34.

Incidentally, the primary current conduction time is set in advance so that energy stored in the ignition coil 15 by current conduction to the primary winding 33 becomes equal to spark energy required for burning an air-fuel mixture under every operating condition of the internal combustion engine.

At the time of generation of the igniting high voltage, a current flows from the auxiliary diode 32 into the low potential side end portion 35 of the secondary winding 34 but there is no current flowing from the ionic current detection circuit 41. The reason why no current flows from the ionic current detection circuit 41 is that the ionic current detection switch 43 is open-circuited, and that the voltage applied to the first charge path-forming diode 49 is reverse bias.

At the time of generation of the igniting high voltage, as described above, an interruption-time primary induced voltage is generated in the primary winding 33. Hence, a current flows from the primary winding 33 into the voltage application capacitor 45 through the second charge path-forming diode 50, so that the voltage application capacitor 45 is charged.

Then, in a time zone of from the point of time t2 to a point of time t3, the magnetic flux energy of the ignition coil 15 is consumed with the continuation of the spark discharge in the spark plug 13. When the voltage generated between the opposite ends of the secondary winding 34 by the magnetic flux energy of the ignition coil 15 becomes lower than the voltage required for the spark discharge, the spark discharge is extinguished naturally because the spark discharge cannot be continued.

When the level of the detection command signal 23 changes from low to high at the point of time t3, the ionic current detection switch 43 is short-circuited. Hence, the current-conduction path ranging from the voltage application capacitor 45 to the secondary winding 34 is made conductive, so that the voltage application capacitor 45 begins to be discharged. On this occasion, if there are ions between the electrodes of the spark plug 13, the waveform of the ionic current is shaped like approximately a bell as shown in a time zone of from the point of time t3 to a point of time t4 in FIG. 2. Because the ionic current flows in this manner, a detection current proportional to the ionic current flows in the detection resistor 47. Hence, a potential difference is generated between the opposite ends of the detection resistor 47, so that the voltage between the opposite ends of the detection resistor 47 changes in accordance with the magnitude of the ionic current.

Incidentally, the energy stored in the voltage application capacity 45 is consumed with the continuation of conduction of the ionic current, so that the voltage stored in the voltage application capacitor 45 is reduced slowly.

Then, at a point of time t5 as the starting point of the next combustion cycle, the level of the first command signal changes from low to high in the same manner as at the point of time t1. Hence, energy for spark discharge begins to be stored in the ignition coil 15. At the same time, the voltage application capacitor 45 begins to be charged. On this occasion, there is no potential change of the center electrode 61 of the spark plug 13, so that there is no spark discharge generated between the electrodes 61 and 63 of the spark plug 13. Incidentally, one combustion cycle is constituted by four stokes, that is, suction, compression, combustion and exhaust strokes.

At a point of time t6, the same operation as at the point of time t2 is performed. At a point of time t7, the same operation as at the point of time t3 is performed. At a point of time t8, the same operation as at the point of time t4 is performed. In this manner, the ignition device 1 for internal combustion engine operates to generate a spark discharge and detect an ionic current.

Incidentally, in a time zone of from the point of time t7 to the point of time t8 in FIG. 2, there is shown the waveform of the ionic current in the case where no ion is produced. In the time zone, there is no waveform change of the ionic current. On this occasion, the voltage between the opposite ends of the voltage application capacitor 45 is not reduced because the voltage application capacitor 45 is not discharged. Even in the case where the voltage application capacitor 45 which has been not discharged yet in this manner is charged in the next combustion cycle, the voltage application capacitor 45 is not overcharged because the voltage between the opposite ends of the voltage application capacitor 45 is limited by the protection Zener diode 51.

Next, an ionic current detecting process executed by the ECU 19 in the ignition device 1 for internal combustion engine will be described with reference to FIG. 3 which is a flow chart showing the process.

Incidentally, the ECU 19 is provided to generally control spark discharge generation timing (ignition timing), fuel injection quantity, idling revolutions (idling speed), etc. in the internal combustion engine. The ECU 19 executes not only the ionic current detecting process which will be described below but also an operational status detecting process or the like separately. The operational status detecting process is a process for detecting operating states of respective parts of the engine, such as intake air flow (intake pipe pressure), rotational speed (engine revolutions), throttle aperture, cooling water temperature, intake air temperature, etc. in the internal combustion engine.

Figure 3:
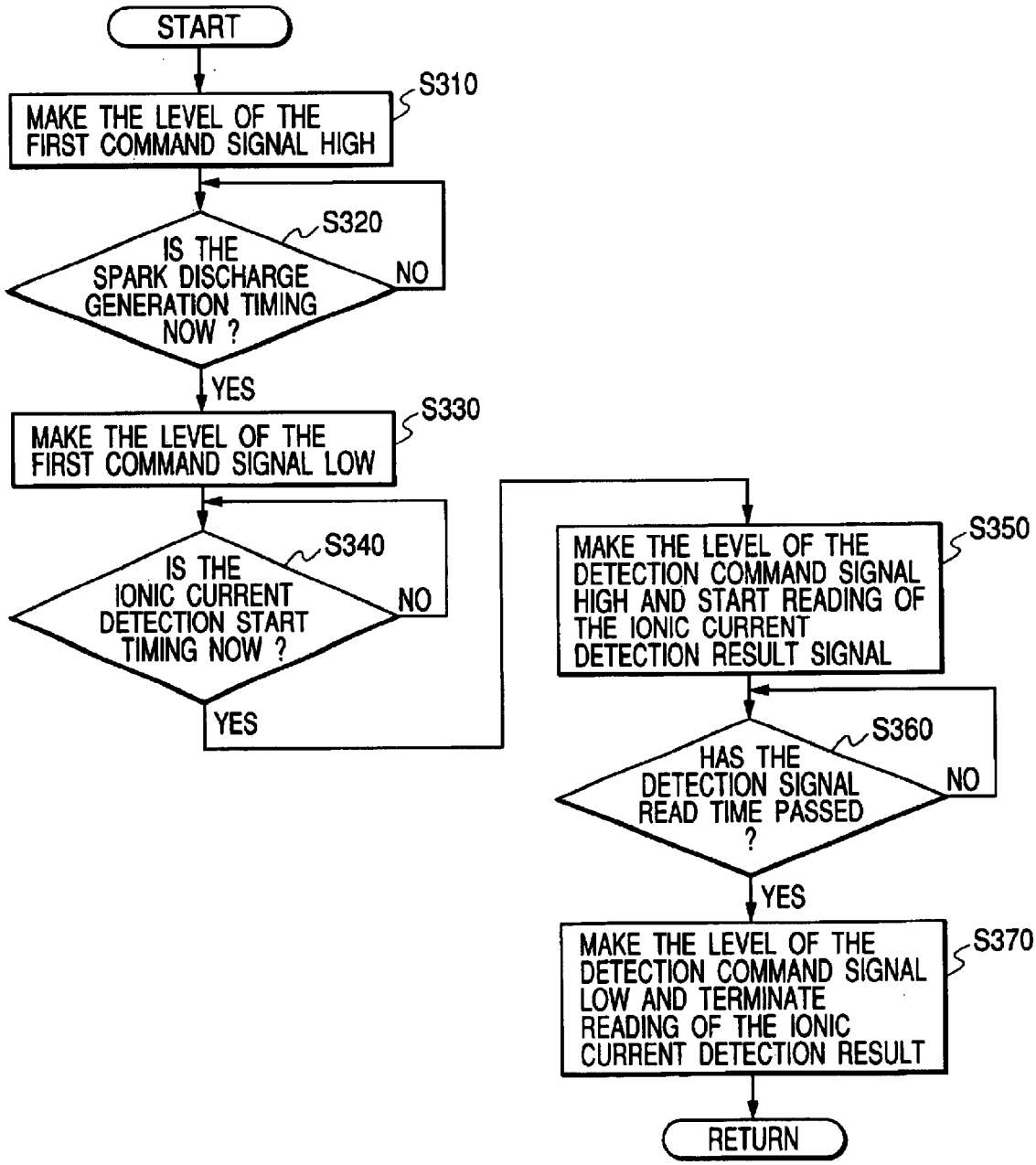
[FIG. 3]
Figure 4:
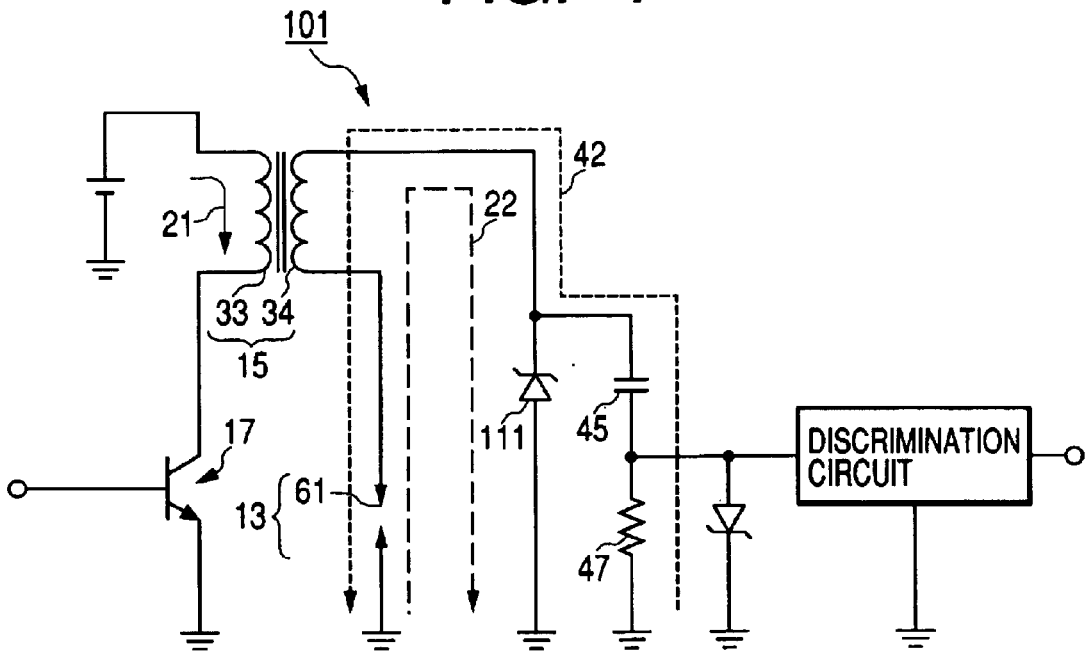
[FIG. 4]
Figure 5:
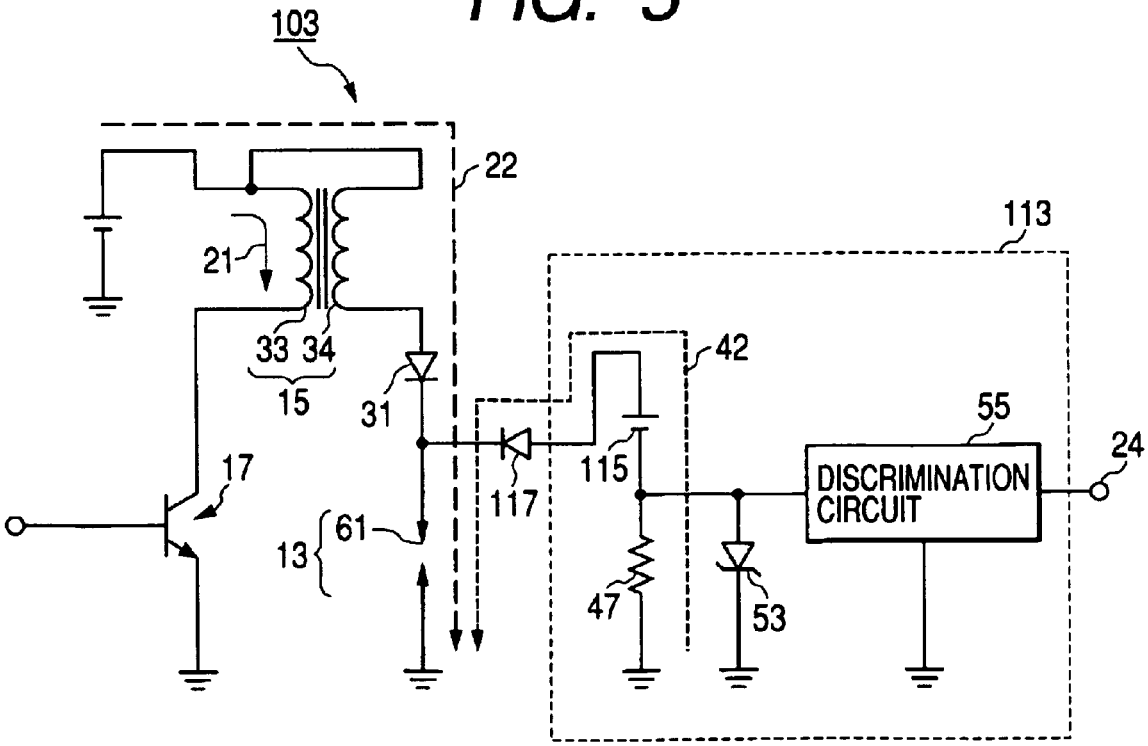
[FIG. 5]
Figure 6:
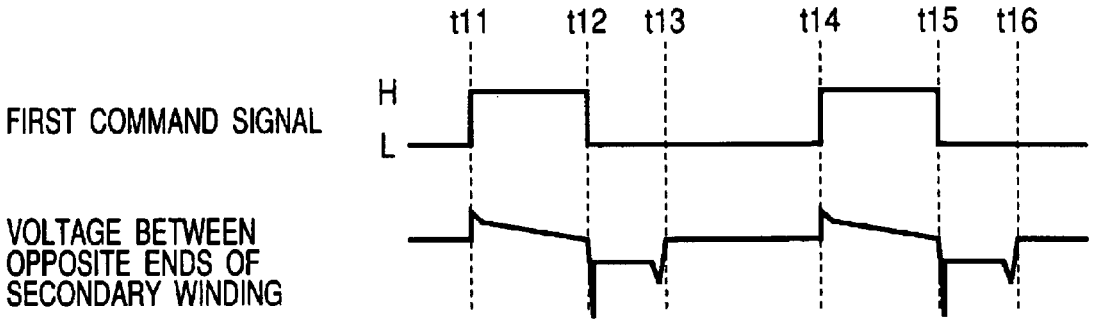
[FIG. 6]

The ionic current detecting process shown in FIG. 3 is executed once on the basis of a signal given from a crank angle sensor detecting a rotational angle (crank angle) of the internal combustion engine whenever one combustion cycle of suction, compression, combustion and exhaust strokes is performed in the internal combustion engine. An ignition control process is executed in combination with the ionic current detecting process.

After the internal combustion engine starts, the ionic current detecting process starts at the primary winding current conduction start timing decided on the basis of the operating state of the internal combustion engine. First, in step S310, the process of turning the level of the first command signal 20 from low to high is carried out so that current conduction to the primary winding 33 is started. That is, when the level of the first command signal 20 is turned from low to high by the step S310, the igniter 17 turns on to start conduction of the primary current 21 to the primary winding 33 of the ignition coil 15 (points of time t1 and t5 in FIG. 2).

Then, in step S320, a judgment is made on the basis of the crank angle detection signal given from the crank angle sensor as to whether the spark discharge generation timing ts is reached or not. The spark discharge generation timing ts is a point of time after the passage of the primary current conduction time from the start point of current conduction to the primary winding 33 in the step S310. When the judgment is "NO", this step S320 is repeatedly carried out to wait until the spark discharge generation timing ts is reached. When the judgment in the step S320 is that the spark discharge generation timing ts is reached (points of time t2 and t6 in FIG. 2), the situation of the process goes to step S330.

In the step S330, the level of the first command signal 20 is reversed from high to low. As a result, the igniter 17 turns off so that the primary current 21 is interrupted. Hence, magnetic flux density in the ignition coil 15 changes rapidly so that an igniting high voltage is generated in the secondary winding 34. Hence, a spark discharge is generated between the electrodes 61 and 63 of the spark plug 13. On this occasion, an interruption-time primary induced voltage is generated so that a current flows from the primary winding 33 into the voltage application capacitor 45 through the second charge path-forming diode 50. Hence, the voltage application capacitor 45 is charged.

In the next step S340, a judgment is made as to whether the ionic current detection start timing ti is reached or not. The ionic current detection start timing ti is set in advance so as to come after the spark discharge is extinguished naturally. When the judgment is "NO", this step S340 is repeatedly carried out to wait until the ionic current detection start timing ti is reached.

When the judgment made in the step S340 is that the ionic current detection start timing ti is reached (points of time t3 and t7 in FIG. 2), the situation of the process goes to step S350. In the step S350, the level of the detection command signal 23 is turned from low to high and reading of the ionic current detection result signal 24 output from the discrimination circuit 55 is started.

The spark discharge in the spark plug 13 has been already extinguished naturally when the situation of the process goes to the step 350 because the ionic current detection start timing ti is set in advance so as to come after the spark discharge is extinguished naturally. Further, because the level of the detection command signal 23 is turned to high so that the ionic current detection switch 43 is short-circuited, the voltage application capacitor 45 begins to be discharged so that an anion current detection voltage is applied between the electrodes 61 and 63 of the spark plug 13.

When there are ions between the electrodes 61 and 63 of the spark plug 13 at the point of time when the ion current detection voltage is applied between the electrodes 61 and 63, an ionic current flows in between the electrodes 61 and 63 so that a voltage proportional to the magnitude of the ionic current is generated between the opposite ends of the detection resistor 47. Hence, the potential of the junction point between the detection resistor 47 and the voltage application capacitor 45 changes in accordance with the voltage between the opposite ends of the detection resistor 47. After a process of the step S350 starts, the process of reading the ionic current detection result signal 24 output from the discrimination circuit 55 in accordance with the change of the voltage between the opposite ends of the detection resistor 47 is carried out continuously in the inside of the ECU 19.

Then, in step S360, a judgment is made as to whether or not the detection signal read time is passed after the judgment of "YES" in the step S340. The detection signal read time is the time required for reading the ionic current detection result signal 24 and is set in the ECU 19 in advance. When the judgment is "NO", this step S360 is repeatedly carried out to wait for the passage of the detection signal read time. When the judgment made in the step S360 is that the detection signal read time is passed (points of time t4 and t8 in FIG. 2), the situation of the process goes to step S370. Although the first embodiment has been described on the case where the detection signal read time is a fixed value set in advance regardless of the operating state of the internal combustion engine, the invention may be also applied to the case where the detection signal read time is set at an appropriate value in accordance with the operating state of the internal combustion engine.

In the step S370, the level of the detection command signal is turned from high to low and the ionic current detection result signal 24 reading process started at the step S350 is stopped. When the process of the step S370 is completed, the ionic current detecting process is terminated.

Incidentally, an ignition failure discrimination process for discriminating ignition failure of the internal combustion engine on the basis of a detection current proportional to the ionic current generated in between the electrodes 61 and 63 of the spark plug 13 is executed in the ECU 19 separately. That is, in the ignition failure discrimination process, ignition failure is discriminated on the basis of the ionic current detection result signal 24 output from the discrimination circuit 55 in a time zone of from the point of time t3 to the point of time t4 in FIG. 2.

In the ignition failure discrimination process, the peak value of the ionic current detection result signal 24 except the peak value just after the point of time t3 is compared with a judgment reference value set in advance for determining whether ignition failure has occurred, so that when the peak value is smaller than the judgment reference value, a decision is made that ignition failure has occurred. In another ignition failure discrimination method, an integrated value of the ionic current detection result signal 24 except the peak value just after the point of time t3 may be calculated in a time zone of the point of time t3 to the point of time t4 and compared with a judgment reference value set in advance for determining whether ignition failure has occurred, so that when the integrated value is smaller than the judgment reference value, a decision is made that ignition failure has occurred. Incidentally, each of the judgment reference values used for determining whether ignition failure has occurred is not limited to a fixed value set in advance. For example, the judgment reference value may be set by a map or calculation formula using the number of engine revolutions and engine load as parameters on the basis of the operating state (e.g., information including the number of engine revolutions and engine load) of the internal combustion engine.

Incidentally, in the ignition device 1 for internal combustion engine according to the first embodiment, the igniter 17 is equivalent to the ignition switching unit in the invention, the reverse current prevention diode 31 is equivalent to the reverse current prevention unit, the voltage application capacitor 45 is equivalent to the voltage application unit, a combination of the detection resistor 47 and the discrimination circuit 55 is equivalent to the ionic current detection unit, the ionic current detection switch 43 is equivalent to the ionic current detection switching unit, the first charge path-forming diode 49 is equivalent to the charge path-forming unit, and the protection Zener diode 51 is equivalent to the protection unit.

Although the first embodiment has been described above, the invention is not limited to the first embodiment and various modes for carrying out the invention may be used.

For example, the ECU 19 may change the time zone (ionic current detection window) in which the ionic current detection switch 43 is drive-controlled to make the current-conduction path conductive, in accordance with the operating state of the internal combustion engine to thereby form an ionic current detection window adapted to the operating state of the internal combustion engine. That is, because a large amount of noise component is superposed on the ionic current just after completion of a spark discharge, the ionic current detection window may be set to avoid the noise component, so that the ionic current can be detected accurately while the influence of noise is suppressed.

Although the ignition device 1 for internal combustion engine according to the first embodiment is configured so that the voltage application capacitor 45 is charged by using both the current-conduction-time secondary induced voltage and the interruption-time primary induced voltage, the ignition device 1 may be configured so that the voltage application capacitor 45 is charged by only the current-conduction-time secondary induced voltage if the voltage application capacitor 45 can be charged sufficiently by only the current-conduction-time secondary induced voltage. Similarly, if the voltage application capacitor 45 can be charged sufficiently by only the interruption-time primary induced voltage, the ignition device 1 may be configured so that the voltage application capacitor 45 is charged by only the interruption-time primary induced voltage.

The igniter 17 is not limited to an igniter constituted by an IGBT. For example, the igniter 17 may be constituted by a switching device such as a bipolar transistor.

The ignition device 1 for internal combustion engine according to the first embodiment can detect not only ignition failure but also a combustion state such as knocking. In order to detect the combustion state, the combustion state can be judged in such a manner that an ionic current flowing in between the electrodes of the spark plug is detected and the waveform of the detected ionic current is analyzed by a known method.

If there is no fear that the voltage application capacitor 45 may be overcharged, the ignition device for internal combustion engine may be configured without provision of the protection Zener diode 51.

Although the first embodiment has described on the ignition device configured so that the center electrode of the spark plug is positive in polarity, circuits may be formed suitably in succession to the technical thought of the invention to obtain an ignition device configured so that the center electrode of the spark plug is negative in polarity. Though the center electrode of the spark plug is negative in polarity in this case, the end portion of the secondary winding connected to the center electrode is equivalent to the igniting high voltage generation end regardless of the polarity.

The ionic current detection start timing ti used in the step S340 of the ionic current detecting process may be set at a point of time when the time required for convergence of voltage-damping oscillation has passed after the point of time of natural extinction of the spark discharge. Hence, charge stored in the voltage application capacitor 45 can be prevented from being released wastefully by the influence of the voltage-damping oscillation. In addition, noise can be prevented from being superposed on the waveform of the detected ionic current by the voltage-damping oscillation so that the detection accuracy of the ion current can be improved.

Next, a second ignition device 2 for internal combustion engine configured so that the spark discharge duration can be set will be described as a second embodiment of the invention.

Figure 7:
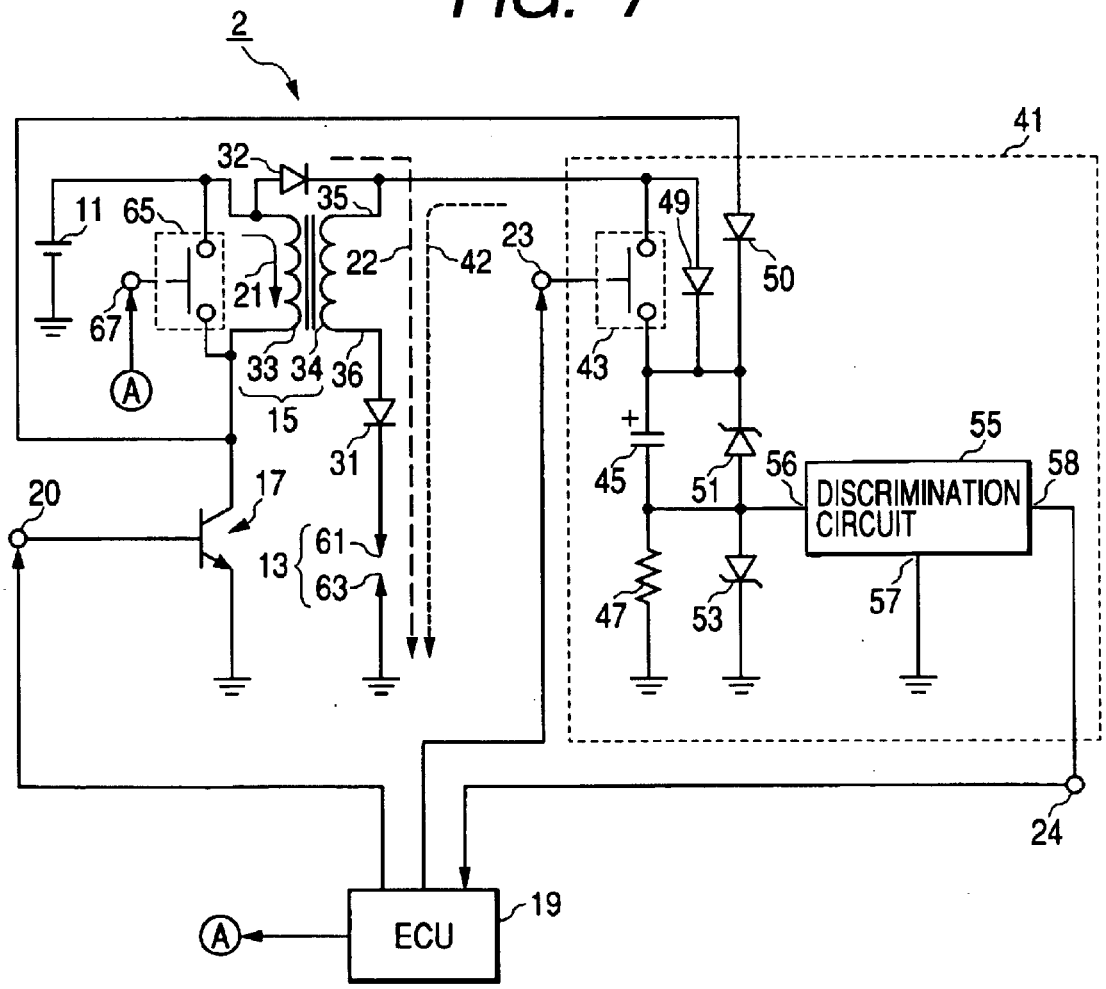
[FIG. 7]

FIG. 7 is an electric circuit diagram showing the configuration of the second ignition device 2 for internal combustion engine. Although the second embodiment will be described on an internal combustion engine provided with one cylinder, the invention may be also applied to an internal combustion engine provided with a plurality of cylinders. Respective ignition devices used in the cylinders of the internal combustion engine are the same in basic configuration.

The second ignition device 2 for internal combustion engine is the same as the ignition device 1 for internal combustion engine according to the first embodiment except that a primary winding short-circuiting switch 65 is provided additionally, and that the content of the ionic current detecting process executed by the ECU 19 is changed. Accordingly, the second ignition device 2 for internal combustion engine will be described on the point of difference from the ignition device 1 for internal combustion engine according to the first embodiment as a topic.

First, the primary winding short-circuiting switch 65 is constituted by a mechanical relay switch and connected in parallel to the primary winding 33 of the ignition coil 15. An internal path of the primary winding short-circuiting switch 65 can be short-circuited or open-circuited on the basis of a discharge control signal 67 given from the ECU 19 to thereby enable a short-circuited state or an open-circuited state between the opposite ends of the primary winding 33. When the level of the discharge control signal 67 is turned to high, the primary winding short-circuiting switch 65 is short-circuited. When the level of the discharge control signal 67 is turned to low, the primary winding short-circuiting switch 65 is open-circuited.

Incidentally, in the same manner as in the ignition device 1 for internal combustion engine according to the first embodiment, the second ignition device 2 for internal combustion engine is configured so that a primary current 21 is carried to the primary winding 33 by the igniter 17 and then interrupted precipitously to generate an igniting high voltage as an induced voltage in the secondary winding 34 to thereby generate a spark discharge in the spark plug 13.

When the opposite ends of the primary winding 33 are short-circuited by the primary winding short-circuiting switch 65 at the time of generation of the igniting high voltage, the direction of the change of the primary current 21 flowing in the primary winding 33 is reversed from a decreasing direction to an increasing direction. Hence, the direction of the change of magnetic flux in the ignition coil 15 is reversed, so that the igniting high voltage generated in the secondary winding 34 is reduced. As a result, the spark discharge is forcibly interrupted.

Figure 8:
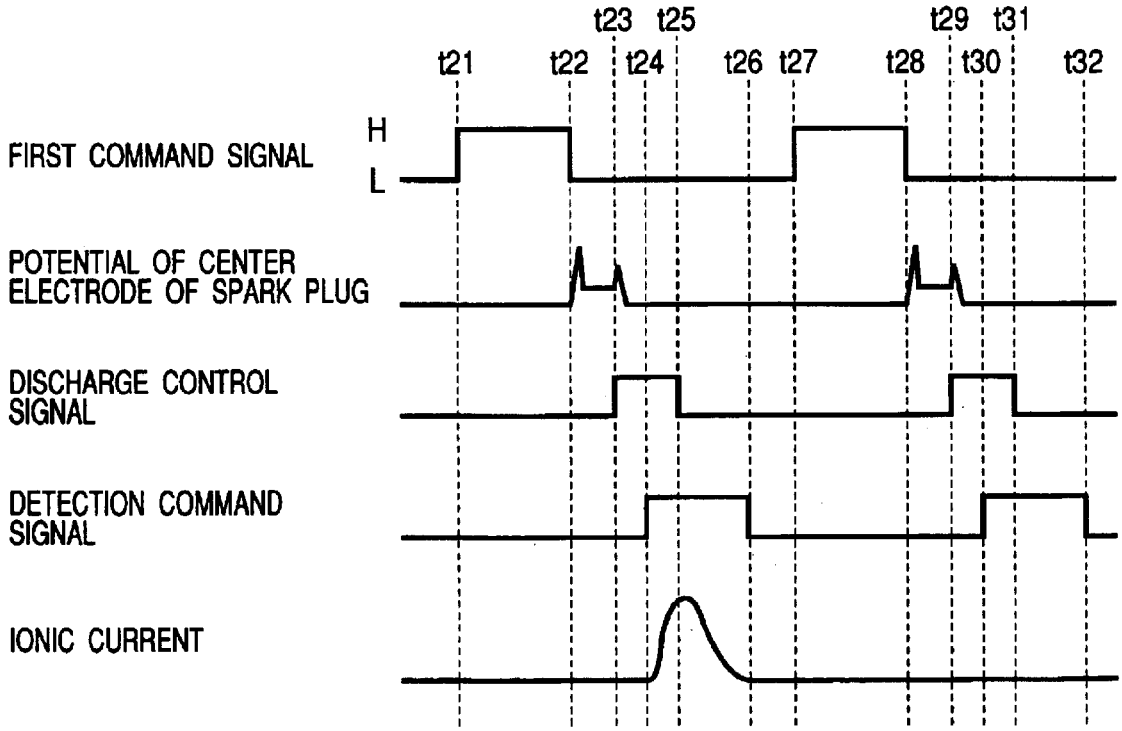
[FIG. 8]

FIG. 8 is a time chart showing states of the first command signal 20, the potential Vp of the center electrode 61 of the spark plug 13, the discharge control signal 67, the detection command signal 23 and the voltage between the opposite ends of the detection resistor 47 (in other words, ionic current) in the circuit diagram of the second ignition device 2 for internal combustion engine shown in FIG. 7.

Incidentally, waveforms at respective parts in the case where an air-fuel mixture is ignited normally are shown in a time zone of from a point of time t21 to a point of time t26 in FIG. 8, and waveforms at respective parts in the case where the air-fuel mixture fails to be ignited are shown in a time zone of from a point of time t27 to a point of time t32 in FIG. 8.

In the time chart shown in FIG. 8, at points of time t23 and t29, the level of the discharge control signal 67 is turned from low to high. The potential Vp of the center electrode 61 of the spark plug 13 is reduced by the operation of the primary winding short-circuiting switch 65 with the change of the level of the discharge control signal 67, so that the spark discharge is forcibly interrupted.

Next a second ionic current detecting process executed by the ECU 19 in the second ignition device 2 for internal combustion engine will be described with reference to FIG. 9 which is a flow chart showing the process.

Incidentally, the ECU 19 is provided for generally controlling spark discharge generation timing (ignition timing), fuel injection quantity, idling revolutions (idling speed), etc. in the internal combustion engine in the same manner as in the first embodiment.

Figure 9:
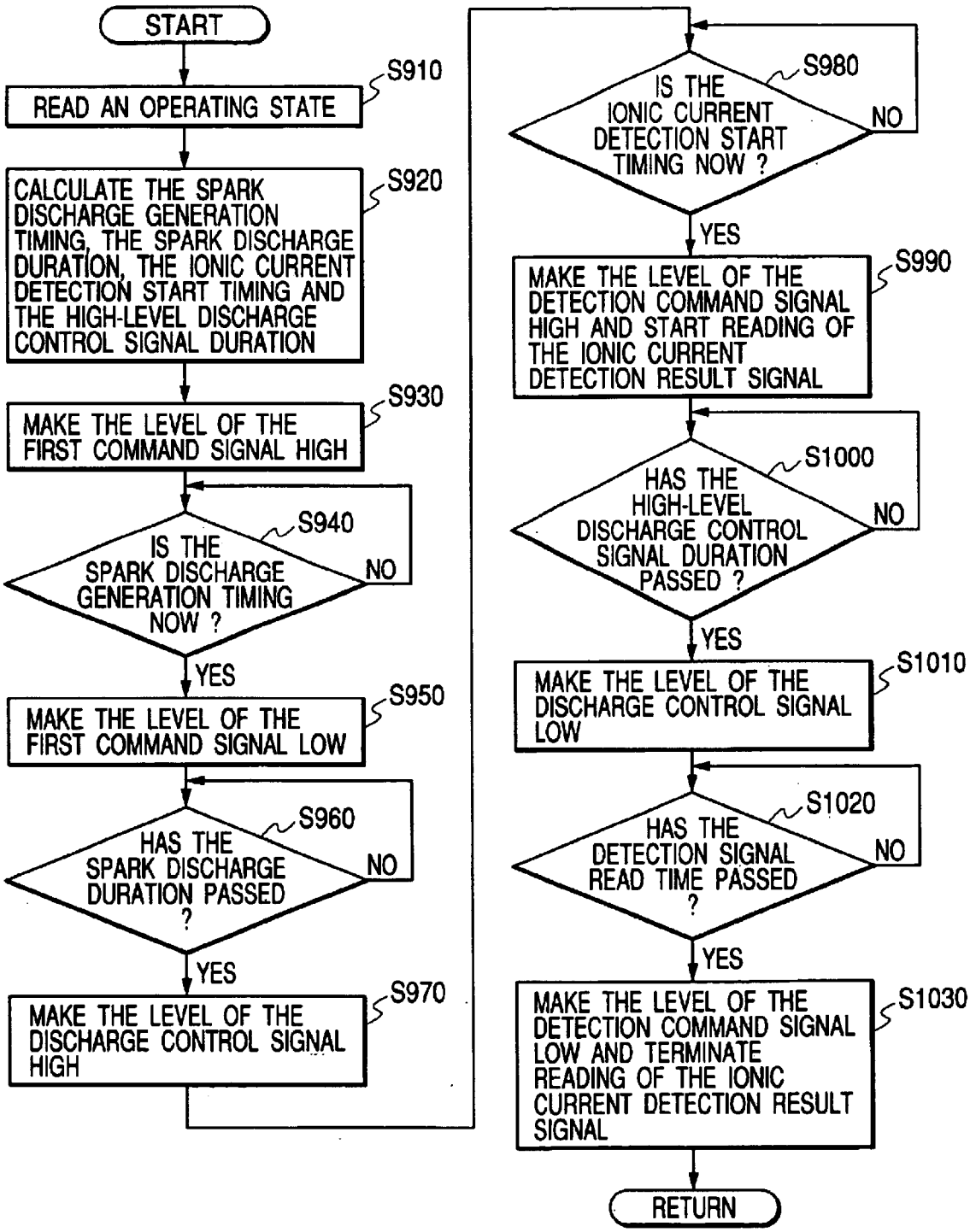
[FIG. 9]

For example, the second ionic current detecting process shown in FIG. 9 is carried out once on the basis of a signal given from a crank angle sensor detecting the rotational angle (crank angle) of the internal combustion engine whenever the internal combustion engine makes one combustion cycle of suction, compression, combustion and exhaust stokes. An ignition control process is carried out in combination with the second ionic current detecting process.

The second ionic current detecting process starts with the start of the internal combustion engine. First, in step S910, the engine operating state detected by an operational status detecting process executed separately is read. In step S920, the spark discharge generation timing ts (so-called ignition timing ts), the spark discharge duration Tt, the ionic current detection start timing ti and the high-level duration Tb of the discharge control signal 67 are calculated on the basis of the operating state read thus.

Incidentally, the spark discharge generation timing ts is calculated, for example, by a procedure of obtaining a control reference value by a map or calculation formula using the intake air quantity and rotational speed of the internal combustion engine as parameters and correcting the control reference value on the basis of cooling water temperature, intake air temperature, etc.

The spark discharge duration Tt is calculated, for example, by a map or calculation formula set in advance on the basis of the rotational speed of the internal combustion engine and the throttle aperture expressing the engine load so that the duration Tt is long under the operating condition (of low load and low rotational speed of the internal combustion engine) that spark energy required for burning the air-fuel mixture is high, but the duration Tt is short under the operating condition (of high load and high rotational speed) that the spark energy is low.

The ionic current detection start timing ti is set at a point of time when the detection delay time Td has passed after the spark interruption timing as the starting point which is a point of time when the spark discharge duration Tt has passed after the spark discharge generation timing ts. Incidentally, the detection delay time Td is set to be not shorter than the time required for convergence of voltage-damping oscillation generated on the secondary side of the ignition coil just after the completion of the spark discharge. Although the time required for convergence of voltage-damping oscillation varies in accordance with the specification of the ignition coil, the operating state of the internal combustion engine, and so on, the time, even the longest time, is generally shorter than 2 ms. In the second ignition device 2 for internal combustion engine, therefore, the detection delay time Td is set at 2 ms.

The high-level duration Tb of the discharge control signal 67 is calculated, for example, by a map or calculation formula set in advance on the basis of the spark discharge duration Tt so that the primary winding short-circuiting switch 65 is kept in a short-circuited state until the magnetic flux B remaining in the ignition coil 15 is spent. Incidentally, the high-level duration Tb of the discharge control signal 67 is set so that the duration Tb is short when the spark discharge duration Tt is long (i.e., when a small amount of magnetic flux B remains in the ignition coil 15), but the duration Tb is long when the spark discharge duration Tt is short (i.e., when a large amount of magnetic flux B remains in the ignition coil 15).

Then, in step S930, the current-conduction start timing of the primary winding 33 is obtained as a point of time earlier by the current-conduction time of the primary winding 33 set in advance than the spark discharge generation timing ts calculated in the step S920, so that the level of the first command signal 20 is turned from low to high at the point of time (t21 or t27 in FIG. 8) when the current-conduction start timing is reached.

When the level of the first command signal 20 is turned from low to high by the process in the step S930, the primary current 21 flows in the primary winding 33 of the ignition coil 15 because the igniter 17 turns on. The current-conduction time of the primary winding 33 up to the spark discharge generation timing ts is set in advance at the time required for carrying the current to the primary winding 33 so that the maximum spark energy required for burning the air-fuel mixture under every operating condition of the internal combustion engine can be stored in the ignition coil 15.

Then, in step S940, a judgment is made on the basis of the detection signal given from the crank angle sensor as to whether the spark discharge generation timing ts calculated in the step S920 is reached or not. When the judgment answers "NO", this step S940 is repeatedly carried out to wait for the spark discharge generation timing ts. When the judgment made in the step S940 is that the spark discharge generation timing ts is reached (points of times t22 and t28 in FIG. 8), the situation of the process goes to step S950.

In the step S950, the level of the first command signal 20 is reversed from high to low as shown at points of time t22 and t28 in FIG. 8. As a result, the igniter 17 turns off, so that the primary current 21 is interrupted. Hence, an igniting high voltage is induced in the secondary winding 34 of the ignition coil 15, so that a spark discharge is generated between the electrodes 61 and 63 of the spark plug 13. On this occasion, an interruption-time primary induced voltage is generated. Hence, a current flows from the primary winding 33 into the voltage application capacitor 45 through the second charge path-forming diode 50, so that the voltage application capacitor 45 is charged.

Then, in step S960, a judgment is made as to whether or not the spark discharge duration Tt calculated in the step S920 has passed after the point of time when the judgment made in the step S940 is that the spark discharge generation timing ts is reached. When the judgment in the step S960 answers "NO", the step S960 is repeatedly carried out to wait for the passage of the spark discharge duration Tt.

When the judgment made in the step S960 is that the spark discharge duration Tt has passed, the situation of the process goes to step S970. In the step S970, the process of turning the level of the discharge control signal 67 from low to high is carried out (points of time t23 and t29 in FIG. 8).

As a result, the primary winding short-circuiting switch 65 turns the state from an open-circuited state to a short-circuited state, so that the opposite ends of the primary winding 33 are short-circuited. Hence, a primary current 21 begins to flow in a closed loop constituted by the primary winding 33 and the primary winding short-circuiting switch 65 on the basis of the magnetic flux remaining in the ignition coil 15. With the flowing of the primary current 21, the direction of the change of magnetic flux in the ignition coil 15 is reversed so that the voltage induced in the secondary winding 34 is reduced. Hence, the voltage applied to the spark plug 13 becomes lower than the voltage required for generation of the spark discharge.

In this manner, the voltage applied to the spark plug 13 is reduced at the time of generation of the spark discharge, so that the spark discharge in the spark plug 13 can be forcibly interrupted.

In the next step S980, a judgment is made as to whether the ionic current detection start timing ti set by the step S920 is reached or not. When the judgment answers "NO", this step S980 is repeatedly carried out to wait for the ionic current detection start timing ti.

When the judgment made in the step S980 is that the ionic current detection start timing ti is reached (points of time t24 and t30 in FIG. 8), the situation of the process goes to step S990. In the step S990, the level of the detection command signal 23 is turned from low to high and reading of the ionic current detection result signal 24 output from the discrimination circuit 55 is started.

The ionic current detection start timing ti is set in the step S920 at a point of time when the detection delay time has passed after the point of time of completion of the spark discharge, and the detection delay time is set to be not shorter than the time required for convergence of voltage-damping oscillation. Accordingly, when the situation of the process goes to the step S990, the voltage-damping oscillation generated on the secondary side of the ignition coil 15 has been already converged (extinguished) with the completion of the spark discharge in the spark plug 13. For this reason, when the level of the detection command signal 23 is turned to high so that the ionic current detection switch 43 is short-circuited, charge stored in the voltage application capacitor 45 is prevented from being released wastefully by the influence of the voltage-damping oscillation.

That is, when the level of the detection command signal 23 is turned to high so that the ionic current detection switch 43 is short-circuited, the voltage generated by discharging the voltage application capacitor 45 is not absorbed to the secondary winding 34 but applied as an ionic current-detecting voltage between the electrodes 61 and 63 of the spark plug 13.

When there are ions between the electrodes 61 and 63 of the spark plug 13 at the point of time when the ionic current-detecting voltage is applied between the electrodes 61 and 63, an ionic current flows in between the electrodes 61 and 63 so that a voltage proportional to the magnitude of the ionic current is generated between the opposite ends of the detection resistor 47. As a result, the potential at the junction point between the detection resistor 47 and the voltage application capacitor 45 changes in accordance with the voltage between the opposite ends of the detection resistor 47 (as shown in a time zone of from a point of time t24 to a point of time t26 in FIG. 8).

On the other hand, when there is no ion between the electrodes 61 and 63 of the spark plug 13 at the point of time when the ionic current-detecting voltage is applied between the electrodes 61 and 63, there is no current flowing in between the electrodes 61 and 63. Hence, the potential at the junction point between the detection resistor 47 and the voltage application capacitor 45 does not change (as shown in a time zone of from a point of time t30 to a point of time t32 in FIG. 8).

After a process in the step S990 starts, the process of reading the ionic current detection result signal 24 output from the discrimination circuit 55 in accordance with the change of the voltage between the opposite ends of the detection resistor 47 is executed continuously in the inside of the ECU 19.

In the next step S1000, a judgment is made as to whether or not the high-level duration Tb of the discharge control signal 67 calculated in the step S920 has passed after the point of time when the judgment in the step S960 answered "YES". When the judgment in the step S1000 answers "YES", the situation of the process shifts to the step 1010. When the judgment in the step S1000 answers "NO", this step S1000 is repeatedly carried out to wait for the passage of the high-level duration Tb.

When the high-level duration Tb of the discharge control signal 67 has passed, the judgment in the step S1000 answers "YES" and the situation of the process goes to step S1010. In the step S1010, the level of the discharge control signal 67 is reversed from high to low (at a point of time t25 in FIG. 8). As a result, the primary winding short-circuiting switch 65 is open-circuited, so that the opposite ends of the primary winding 33 turn from a short-circuited state to an open-circuited state. Incidentally, on this occasion, there is no current flowing the primary winding 33 because all magnetic flux in the ignition coil 15 is spent. Hence, voltage-damping oscillation is not generated on the secondary side of the ignition coil 15 regardless of the change of the state of the primary winding short-circuiting switch 65.

In the next step S1020, a judgment is made as to whether or not the detection signal read time set as the time required for reading the ionic current detection result signal 24 in the ECU 19 in advance has passed after the point of time when the judgment in the step S980 answered "YES". When the judgment in the step S1020 answers "NO", this step S1020 is repeatedly carried out to wait for the passage of the detection signal read time. When the judgment in the step S1020 is that the detection signal read time has passed (at points of time t26 and t32 in FIG. 8), the situation of the process goes to step S1030. Although the second embodiment has shown the case where the detection signal read time is a fixed time set in advance regardless of the operating state of the internal combustion engine, the invention may be also applied to the case where the detection signal read time is set at an appropriate value in accordance with the operating state of the internal combustion engine.

In the step S1030, the level of the detection command signal 23 is turned from high to low and the process started at the step S990 for reading the ionic current detection result signal 24 is stopped. When the process in the step S1030 is completed, the second ionic current detecting process is terminated.

Incidentally, an ignition failure discrimination process for discriminating ignition failure of the internal combustion engine on the basis of a detection current proportional to the ionic current generated in between the electrodes 61 and 63 of the spark plug 13 is executed separately by the ECU 19 in the same manner as in the first embodiment. That is, in the ignition failure discrimination process, ignition failure is discriminated in a time zone of from a point of time t24 to a point of time t26 and in a time zone of from a point of time t30 to a point of time t32 in FIG. 8 on the basis of the ionic current detection result signal 24 output from the discrimination circuit 55.

Incidentally, in the second ignition device 2 for internal combustion engine according to the second embodiment, the step S920 in the second ionic current detecting process is equivalent to a combination of the detection timing control unit and the spark discharge duration calculation unit in the invention, and the primary winding short-circuiting switch 65 is equivalent to the spark discharge interruption unit.

Incidentally, because the second ignition device 2 for internal combustion engine is the same as the ignition device 1 for internal combustion engine according to the first embodiment except that the primary winding short-circuiting switch 65 is provided additionally and that the content of the ionic current detecting process is formed additionally, it is a matter of course that the same effect as that of the ignition device 1 for internal combustion engine according to the first embodiment can be obtained in the second ignition device 2.

Although the second embodiment of the invention has been described above, the invention is not limited to the second embodiment and various modes for carrying out the invention may be used.

For example, the primary winding short-circuiting switch 65 is not limited to a mechanical relay switch and may be constituted by a switching element made of a semiconductor device such as a thyristor, a power transistor or an FET.

Especially, a thyristor has the property in which the state of the thyristor changes from a current-conduction state to an interruption state automatically when a current flowing in the thyristor is reduced to zero after a drive start signal is input to the thyristor to make the thyristor in a current-conduction state. Therefore, when the primary winding short-circuiting switch 65 is constituted by a thyristor, the process of setting or changing the timing for turning the opposite ends of the primary winding from an short-circuited state to an open-circuited state is unnecessary if only the process of controlling the timing for turning the opposite ends of the primary winding from an open-circuited state to a short-circuited state can be executed. Hence, a fixed value can be set in the high-level duration Tb of the discharge control signal 67 in advance. Because the process of setting the high-level duration Tb of the discharge control signal 67 in accordance with the operating state of the internal combustion engine is unnecessary, the content of processing by the ECU 19 can be simplified and the load on processing by the ECU 19 can be lightened.

The spark discharge interruption unit for interrupting the spark discharge by re-starting current conduction to the primary winding is not limited to a unit connected in parallel to the primary winding. For example, interruption of the spark discharge may be achieved by driving (turning on) a switching element which is made of a semiconductor device such as a power transistor or an FET provided in a general contactless transistor type ignition device for switching either conduction or non-conduction of a current to the primary winding of the ignition coil. Also in another type ignition device than the contactless transistor type ignition device, an electrical or mechanical switching unit is provided for switching either conduction or non-conduction of a current to the primary winding of the ignition coil. Therefore, such a switching unit may be formed so that the switching unit itself can be made conductive. A second switching unit may be provided in parallel to the switching unit so that the second switching unit itself can be made conductive.

The detection delay time Td is not limited to a fixed value and may be set in accordance with the operating state of the internal combustion engine. For example, when the spark discharge duration Tt is long (i.e., when a small amount of magnetic flux B remains in the ignition coil 15), the detection delay time Td may be set to be long because the time required for convergence of voltage-damping oscillation is long. On the other hand, when the spark discharge duration Tt is short (i.e., when a large amount of magnetic flux B remains in the ignition coil 15), the detection delay time Td may be set to be short because the time required for convergence of voltage-damping oscillation is short. Incidentally, the detection delay time Td may be calculated by a map or calculation formula set in advance, for example, on the basis of the spark discharge duration Tt.

Figure 10:
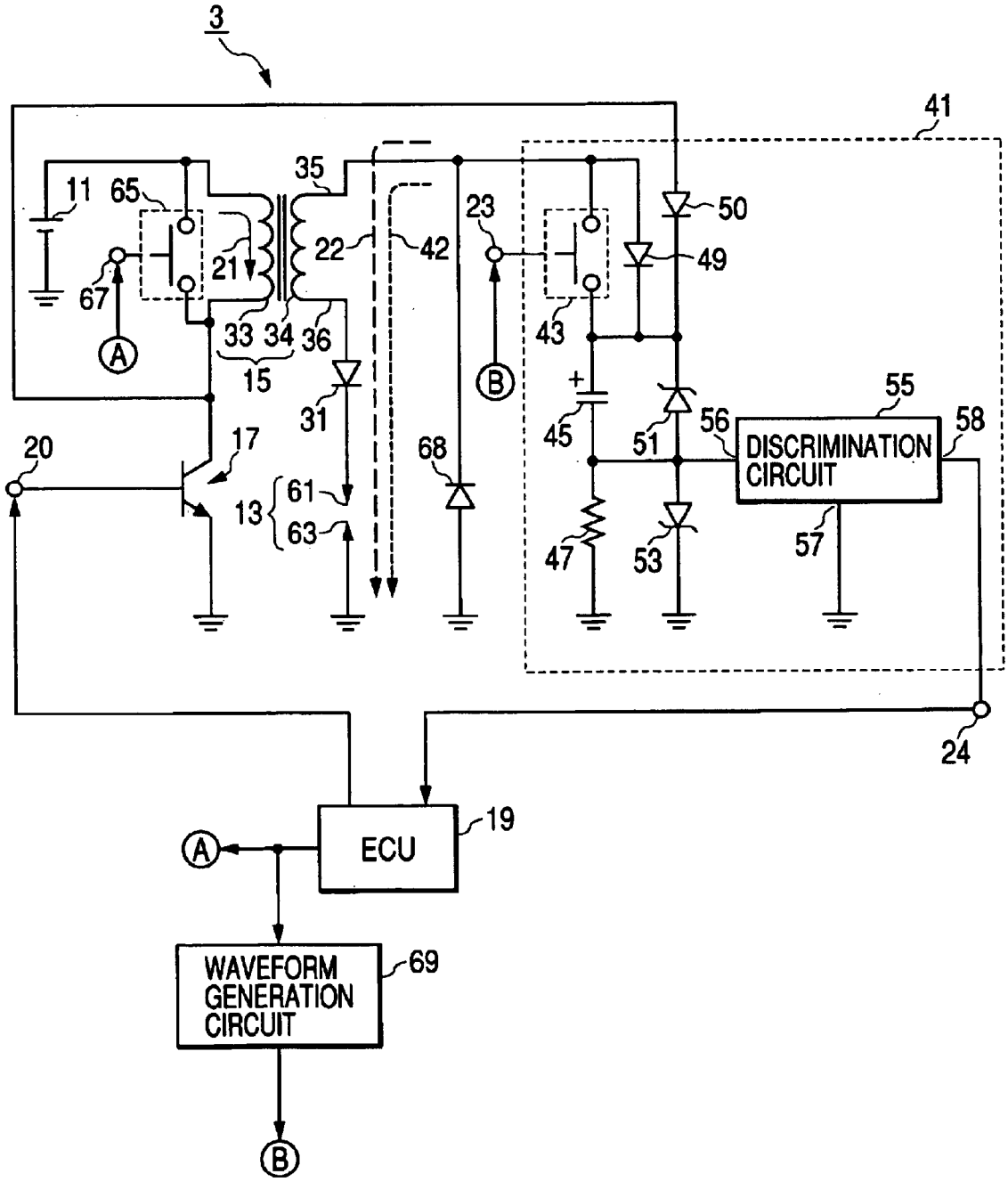
[FIG. 10]

Incidentally, the position of connection of the auxiliary diode 32 is not limited to the case where the auxiliary diode 32 is connected between the primary winding 33 and the secondary winding 34. For example, as shown in FIG. 10 which is a diagram showing a third ignition device 3 for internal combustion engine according to a third embodiment of the invention, the auxiliary diode 32 may be replaced by a second auxiliary diode 68 which has an anode connected to the ground, and a cathode connected to the low potential side end portion 35 of the secondary winding 34.

That is, the auxiliary diode 32 in each of the first and second embodiments forms a current-conduction path ranging from the primary winding 33 to the secondary winding 34. When the secondary winding 34 and the ionic current detection circuit 41 are electrically disconnected from each other by a certain cause, the auxiliary diode 32 functions as a unit for forming an auxiliary discharge path which serves as a by-path for the discharge current.

Also in the second auxiliary diode 68 in the third ignition device 3 for internal combustion engine, a current-conduction path ranging from the ground to the secondary winding 34 can be formed to be secured as a current-conduction path for the discharge current even in the case where the secondary winding 34 and the ionic current detection circuit 41 are electrically disconnected from each other by a certain cause.

The third ignition device 3 for internal combustion engine further has a waveform generation circuit 69 so that the load on processing by the ECU 19 can be lightened.

The waveform generation circuit 69 is configured so that the discharge control signal 67 from the ECU 19 is input to the waveform generation circuit 69 and so that the detection command signal 23 is output from the waveform generation circuit 69 to the ionic current detection circuit 41. The waveform generation circuit 69 begins to output the high-level detection command signal 23 at the point of time when the detection delay time Td has passed after the starting point of time when the level of the discharge control signal 67 was turned from low to high. Then, the waveform generation circuit 69 reverses the level of the detection command signal 23 from high to low at the point of time when the detection signal read time set in advance as the time required for reading the ionic current detection result signal 24 has passed. Incidentally, the waveform generation circuit 69 outputs the low-level detection command signal 23 regardless of the state of the discharge control signal 67 (i.e., regardless of whether the level of the discharge control signal 67 is low or high) when the detection signal read time has passed after the high-level detection command signal 23 began to be output.

Incidentally, a third ionic current detecting process executed by the ECU 19 in the third ignition device 3 for internal combustion engine is configured so that the process of calculating the ionic current detection start timing ti in the step S920, the process of turning the level of the detection command signal 23 to high in the step S990, and the process of turning the level of the detection command signal 23 to low in the step S1030 are removed from the second ionic current detecting process shown in FIG. 9. Because the process contents are omitted as described above, the load on the ionic current detecting process executed by the ECU 19 in the third ignition device 3 for internal combustion engine can be lightened compared with the load on the same process executed by the ECU 19 in the second embodiment.

Incidentally, the third ignition device 3 for internal combustion engine has the second auxiliary diode 68 provided in place of the auxiliary diode 32 of the second ignition device 2 for internal combustion engine, and the waveform generation circuit 69 provided newly, and is further configured to have modifications additionally so that the ECU 19 executes the third ionic current detecting process in place of the second ionic current detecting process. Accordingly, it is a matter of course that the same effect as that of the second ignition device 2 for internal combustion engine can be obtained in the third ignition device 3 for internal combustion engine. The waveform generation circuit 69 is equivalent to the detection timing control unit in the invention.

Figure 11:
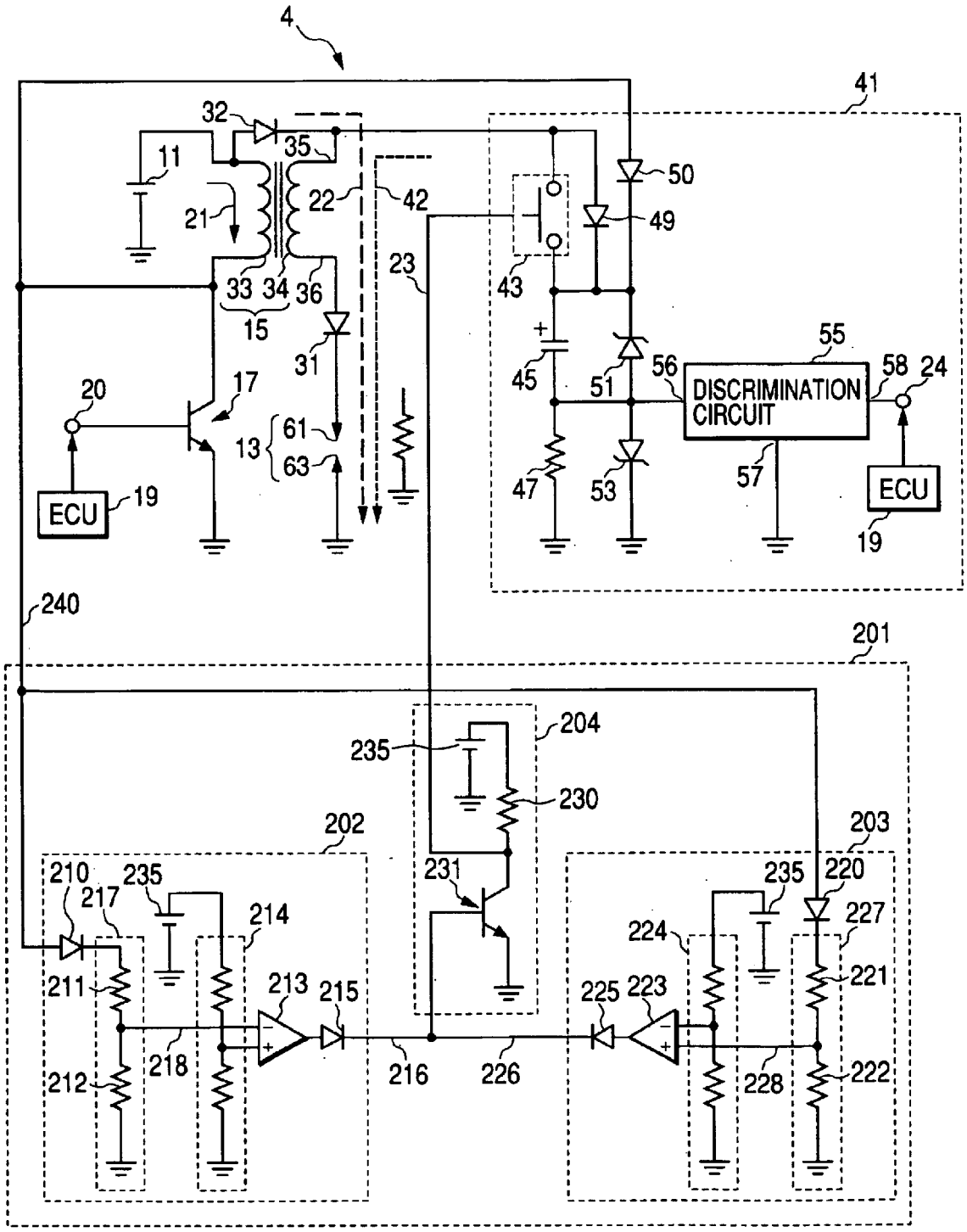
[FIG. 11]

Next, a fourth ignition device 4 for internal combustion engine configured so that the current-conduction duration of the primary current and the spark discharge duration are detected to thereby make it possible to control the ionic current detection switch to be short-circuited or open-circuited will be described as a fourth embodiment of the invention. FIG. 11 is an electric circuit diagram showing the configuration of the fourth ignition device 4 for internal combustion engine. Although the fourth embodiment will be described on an internal combustion engine provided with one cylinder, the invention may be also applied to an internal combustion engine provided with a plurality of cylinders. Respective ignition devices provided in the cylinders of the internal combustion engine are the same in basic configuration.

The fourth ignition device 4 for internal combustion engine is formed so that a switching drive control circuit 201 is added to the ignition device 1 for internal combustion engine according to the first embodiment. Incidentally, in FIG. 11, parts the same as those in FIG. 1 are referred to by numerals the same as those in FIG. 1. The configuration and operation of the fourth embodiment are the same as those of the first embodiment except the switching drive control circuit 201. Accordingly, the configuration of the switching drive control circuit 201 and the operation for generating a current-conduction command signal 216 and a discharge command signal 226 will be described mainly here.

First, the switching drive control circuit 201 in the fourth ignition device 4 for internal combustion engine has a current-conduction duration detection circuit 202 for detecting the current-conduction duration of the primary current, a discharge duration detection circuit 203 for detecting the spark discharge duration, and a switching drive circuit 204.

The current-conduction duration detection circuit 202 has a first diode 210, a first resistor 211, a second resistor 212, and a first operational amplifier 213. The first diode 210 has an anode connected to a junction point between the collector of the igniter 17 and the primary winding 33, and a cathode connected to one end of the first resistor 211. The second resistor 212 has one end connected to the other end of the first resistor 211, and the other end connected to the ground equal in potential to the negative electrode of the power supply unit 11. The first operational amplifier 213 has an inversional input portion (−) connected to a junction point between the first resistor 211 and the second resistor 212. Incidentally, the first and second resistors form a first voltage dividing circuit 217. Further, two resistors form a second voltage dividing circuit 214. The first operational amplifier 213 further has a non-inversional input portion (+) connected to a junction point between the two resistors of the second voltage dividing circuit 214. Incidentally, the second voltage dividing circuit 214 has one end connected to a power supply line 235 (generally, 5 V), and an opposite end connected to the ground equal in potential to the negative electrode of the power supply unit 11. The first operational amplifier 213 further has an output portion connected to an anode of a second diode 215. A cathode of the second diode 215 is connected to a base of a transistor 231 in the switching drive circuit 204.

Like the current-conduction duration detection circuit 202, the discharge duration detection circuit 203 has a third diode 220, a third resistor 221, a fourth resistor 222, and a second operational amplifier 223. The third diode 220 has an anode connected to a junction point between the collector of the igniter 17 and the primary winding 33, and a cathode connected to one end of the third resistor 221. The fourth resistor 222 has one end connected to the other end of the third resistor 221, and the other end connected to the ground equal in potential to the negative electrode of the power supply unit 11. The second operational amplifier 223 has an inversional input portion (−) connected to a junction point between the third resistor 221 and the fourth resistor 222. Incidentally, the third and fourth resistors form a third voltage dividing circuit 227. Further, two resistors form a fourth voltage dividing circuit 224. The second operational amplifier 223 further has a non-inversional input portion (+) connected to a junction point between the two resistors of the fourth voltage dividing circuit 224. Incidentally, the fourth voltage dividing circuit 224 has one, end connected to the power supply line 235 (generally, 5 V), and an opposite end connected to the ground equal in potential to the negative electrode of the power supply unit 11. The second operational amplifier 223 further has an output portion connected to an anode of a fourth diode 225. A cathode of the fourth diode 225 is connected to the junction point between the base of the transistor 231 in the switching drive circuit 204 and the second diode 215.

The switching drive circuit 204 has the transistor 231. The transistor 231 has a base connected to the junction point between the cathode of the second diode 215 and the cathode of the fourth diode 225, an emitter connected to the ground equal in potential to the negative electrode of the power supply unit 11, and a collector connected to the power supply line 235 through a fifth resistor 230. The ionic current detection switch 43 is connected to a junction point between the collector of the transistor 231 and the fifth resistor 230.

Figure 12:
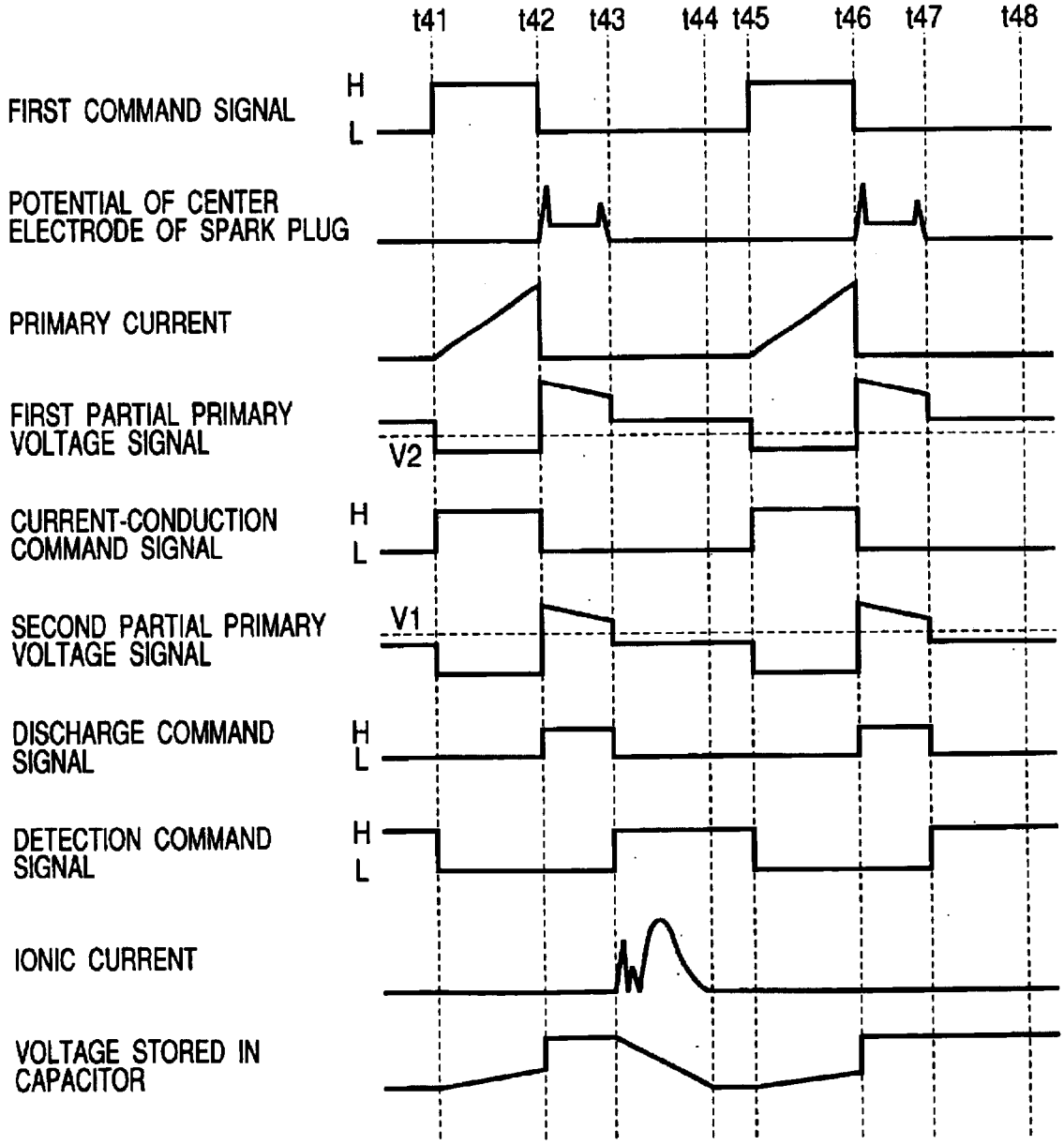
[FIG. 12]

Next, in the fourth ignition device 4 for internal combustion engine, an operation for generating the current-conduction command signal 216, an operation for generating the discharge command signal 226 and an operation for generating the detection command signal 23 will be described (see FIG. 12).

First, in the primary winding current-conduction duration, a primary voltage signal 240 is supplied from the junction point between the primary winding 33 and the igniter 17 into the first voltage dividing circuit 217 through the first diode 210 in the current-conduction duration detection circuit 202. The primary voltage signal 240 supplied to the first voltage dividing circuit 217 is divided into parts by the first voltage dividing circuit 217, so that a divided part of the primary voltage signal 240 (hereinafter referred to as first partial primary voltage signal 218) is supplied to the first operational amplifier 213. In the first operational amplifier 213, the level of the first partial primary voltage signal 218 is compared with a threshold V2 given from the second voltage dividing circuit 214. Hence, the first operational amplifier 213 generates the current-conduction command signal 216 so that the level of the current-conduction command signal 216 becomes high when the level of the first partial primary voltage signal 218 is lower than the threshold V2, but the level of the current-conduction command signal 216 becomes low when the level of the first partial primary voltage signal 218 is not lower than the threshold V2.

Then, in the spark discharge duration, the primary voltage signal 240 is supplied from the junction point between the primary winding 33 and the igniter 17 into the third voltage dividing circuit 227 through the third diode 220 in the discharge duration detection circuit 203. The primary voltage signal 240 supplied to the third voltage dividing circuit 227 is divided into parts by the third voltage dividing circuit 227, so that a divided part of the primary voltage signal 240 (hereinafter referred to as second partial primary voltage signal 228) is supplied to the second operational amplifier 223. In the second operational amplifier 223, the level of the second partial primary voltage signal 228 is compared with a threshold V1 given from the fourth voltage dividing circuit 224. Hence, the second operational amplifier 223 generates the discharge command signal 226 so that the level of the discharge command signal 226 becomes high when the level of the second partial primary voltage signal 228 is not lower than the threshold V1, but the level of the discharge command signal 226 becomes low when the level of the second partial primary voltage signal 228 is lower than the threshold V1.

In the switching drive circuit 204, when either the current-conduction command signal 216 or the discharge command signal 226 is supplied to the base, of the transistor 231, a voltage is applied between the base and the emitter of the transistor 231. Hence, the transistor 231 turns on, so that a current flows from the power supply line to the ground. Hence, the level of the detection command signal 23 becomes low, so that the ionic current detection switch 43 is open-circuited.

When neither the current-conduction command signal 216 nor the discharge command signal 226 is supplied to the base of the transistor 231, there is no voltage applied between the base and the emitter of the transistor 231. Hence, the transistor 231 turns off, so that the detection command signal 23 is supplied to the ionic current detection switch 43 connected to the junction point between the collector of the transistor 231 and the resistor 230. Hence, the ionic current detection switch 43 is short-circuited.

Incidentally, in the fourth ignition device 4 for internal combustion engine according to the fourth embodiment, the switching drive control circuit 201 is equivalent to the switching drive unit.

Incidentally, the fourth ignition device 4 for internal combustion engine is configured so that the switching drive control circuit 201 is added to the ignition device 1 for internal combustion engine according to the first embodiment, and so that the detection command signal 23 is generated on the basis of the current-conduction command signal 216 and the discharge command signal 226. Accordingly, it is a matter of course that the same effect as that of the ignition device 1 for internal combustion engine can be obtained in the fourth ignition device 4 for internal combustion engine.

This application is based on Japanese Patent application JP 2001-364732, filed Nov. 29, 2001, Japanese Patent application JP 2002-085756, filed Mar. 26, 2002, and Japanese Patent application JP 2002-087062, filed Mar. 26, 2002, the entire contents of those are hereby incorporated by reference, the same as if set forth at length.

What is claimed is:

1. An ignition device for an internal combustion engine comprising:

an ignition coil comprising a primary winding and a, secondary winding, the ignition coil generating an igniting high voltage in the secondary winding by turning off a primary current flowing in the primary winding;

an ignition switching unit for turning on/off the primary current;

a spark plug connected to an igniting high voltage generation end of the secondary winding for generating a spark discharge between electrodes of the spark plug in a condition that a discharge current generated on a basis of the igniting high voltage flows in the spark plug;

a reverse current prevention unit series-connected on a current-conduction path of the discharge current connecting the secondary winding to the spark plug, the reverse current prevention unit permitting conduction of the discharge current in the spark plug but preventing conduction of a current generated in the secondary winding at a time of carrying a current to the primary winding;

a voltage application unit connected to an other end of the secondary winding opposite to the igniting high voltage generation end for applying an ionic current-detecting voltage to the spark plug, the ionic current-detecting voltage being identical in polarity to the igniting high voltage applied to the spark plug;

an ionic current detection unit for detecting an ionic current flowing in between the electrodes on a basis of application of the ionic current-detecting voltage; and an ionic current detection switching unit series-connected on a current-conduction path of the ionic current-detecting voltage connecting the voltage application unit to the other end for making the current-conduction path non-conductive to apply the ionic current-detecting voltage at a time of generation of the igniting high voltage but making the current-conduction path conductive to apply the ionic current-detecting voltage at a time of detection of the ionic current on a basis of external commands.

2. The ignition device for internal combustion engine according to claim 1, wherein the voltage application unit is formed electrically chargeably and dischargeably so that the voltage application unit is electrically charged by an interrupting-time primary induced voltage generated between opposite ends of the primary winding at a time of conduction of the discharge current to thereby apply the ionic current-detecting voltage to the spark plug.

3. The ignition device for internal combustion engine according to claim 1, wherein the voltage application unit is formed electrically chargeably and dischargeably so that the voltage application unit is electrically charged by a current-conduction-time secondary induced voltage generated between opposite ends of the secondary winding at a time of current-conduction of the primary winding to thereby apply the ionic current-detecting voltage to the spark plug.

4. The ignition device for internal combustion engine according to claim 1, wherein the voltage application unit is formed electrically chargeably and dischargeably so that the voltage application unit is electrically charged by both a current-conduction-time secondary induced voltage generated between opposite ends of the secondary winding at a time of current-conduction of the primary winding and an interrupting-time primary induced voltage generated between opposite ends of the primary winding at a time of conduction of the discharge current to thereby apply the ionic current-detecting voltage to the spark plug.

5. The ignition device for internal combustion engine according to claim 3, further comprising a charge path-forming unit connected in parallel to the ionic current detection switching unit for preventing conduction of the discharge current but permitting conduction of a current generated on a basis of the current-conduction-time secondary induced voltage, wherein the current generated on the basis of the current-conduction-time secondary induced voltage is supplied to the voltage application unit through the charge path-forming unit to thereby electrically charge the voltage application unit.

6. The ignition device for internal combustion engine according to claim 4, further comprising a charge path-forming unit connected in parallel to the ionic current detection switching unit for preventing conduction of the discharge current but permitting conduction of a current generated on a basis of the current-conduction-time secondary induced voltage, wherein the current generated on the basis of the current-conduction-time secondary induced voltage is supplied to the voltage application unit through the charge path-forming unit to thereby electrically charge the voltage application unit.

7. The ignition device for internal combustion engine according to claim 5, wherein the charge path-forming unit comprises a diode.

8. The ignition device for internal combustion engine according to claim 6, wherein the charge path-forming unit comprises a diode.

9. The ignition device for internal combustion engine according to claim 2, wherein the voltage application unit comprises a capacitor.

10. The ignition device for internal combustion engine according to claim 2, further comprising a protection unit for protecting the voltage application unit by limiting a charge voltage of the voltage application unit to be not higher than an allowable maximum charge voltage value.

11. The ignition device for internal combustion engine according to claim 10, wherein the protection unit comprises a Zener diode.

12. The ignition device for internal combustion engine according to claim 1, further comprising a detection timing control unit for drive-controlling the ionic current detection switching unit to make the current-conduction path conductive to apply the ionic current-detecting voltage after a passage of a detection delay time required for convergence of voltage-damping oscillation generated on the secondary side of the ignition coil after completion of a spark discharge in the spark plug.

13. The ignition device for internal combustion engine according to claim 1, further comprising:

a spark discharge duration calculation unit for calculating a spark discharge duration required for combustion of an air-fuel mixture by the spark discharge, on a basis of an operating state of the internal combustion engine; and a spark discharge interruption unit for forcibly interrupting the spark discharge in accordance with the spark discharge duration calculated by the spark discharge duration calculation unit.

14. The ignition device for internal combustion engine according to claim 13, wherein the spark discharge interruption unit forcibly interrupts the spark discharge by re-starting current conduction to the primary winding in accordance with timing of passage of the spark discharge duration after the ignition switching unit turns off a current flowing in the primary winding.

15. The ignition device for internal combustion engine according to claim 1, wherein the external commands are controlled by a switching drive unit for switching-controlling the ionic current detection switching unit on a basis of at least one of a duration of conduction of the primary current and the spark discharge duration.

* * * * *